US006772570B2

(12) United States Patent
Horne

(10) Patent No.: US 6,772,570 B2
(45) Date of Patent: Aug. 10, 2004

(54) VARIABLE PITCH CONNECTOR BRACKETS FOR USE IN ATTACHING SUPPORTING MEMBERS TO BEARING MEMBERS IN ROOFS

(76) Inventor: Edward Horne, 5939 Bonnard Dr., Dallas, TX (US) 75230

( * ) Notice: Subject to any disclaimer, the term of this patent is extended or adjusted under 35 U.S.C. 154(b) by 0 days.

(21) Appl. No.: 10/291,573

(22) Filed: Nov. 12, 2002

(65) Prior Publication Data

US 2003/0233805 A1 Dec. 25, 2003

Related U.S. Application Data

(63) Continuation-in-part of application No. 09/690,466, filed on Oct. 18, 2000, now abandoned.

(51) Int. Cl.[7] ..... F16B 7/08

(52) U.S. Cl. ..... 52/655.1; 52/715; 52/92.2; 52/640

(58) Field of Search ..... 52/712, 715, 745.06, 52/655.1, 90.1, 92.2, 640, 641

(56) References Cited

U.S. PATENT DOCUMENTS

| | | | | |
|---|---|---|---|---|
| 3,036,347 A | | 5/1962 | Findleton | |
| 3,184,800 A | * | 5/1965 | Nelson | 403/219 |
| 3,423,898 A | * | 1/1969 | Coloney et al. | 52/713 |
| 3,727,358 A | | 4/1973 | Howell | |
| 3,971,183 A | | 7/1976 | Padleckas et al. | |
| 4,022,537 A | * | 5/1977 | Gilb et al. | 403/386 |
| 4,148,164 A | * | 4/1979 | Humphrey | 52/94 |
| 4,335,555 A | | 6/1982 | Southerland et al. | |
| 4,410,294 A | * | 10/1983 | Gilb et al. | 403/27 |
| 4,498,801 A | | 2/1985 | Gilb | |
| 4,998,389 A | | 3/1991 | Pritts | |
| 5,004,369 A | * | 4/1991 | Young | 403/232.1 |
| 5,217,317 A | * | 6/1993 | Young | 403/232.1 |
| 5,230,198 A | | 7/1993 | Callies | |
| 5,335,469 A | | 8/1994 | Stuart | |
| 5,448,871 A | * | 9/1995 | Newman et al. | 52/712 |
| 5,546,726 A | | 8/1996 | Stalzer | |
| 5,560,156 A | * | 10/1996 | McDonald | 52/92.2 |
| 5,568,862 A | | 10/1996 | Black, Jr. | |
| 5,797,694 A | | 8/1998 | Breivik | |
| 6,047,513 A | | 4/2000 | Gibson | |

FOREIGN PATENT DOCUMENTS

| | | |
|---|---|---|
| DE | 2714300 | 10/1978 |
| GB | 185694 | 9/1922 |
| GB | 2222221 | 2/1990 |

* cited by examiner

*Primary Examiner*—Carl D. Friedman
*Assistant Examiner*—Basil Katcheves
(74) *Attorney, Agent, or Firm*—Patton Boggs LLP

(57) ABSTRACT

A roof framing system includes a first bracket and a second bracket. The first bracket attaches a first rafter and a second rafter to a ridge beam. The second bracket attaches a third rafter, through the first bracket, to the ridge beam. The first bracket and/or the second bracket includes one or more projections for interlocking with the other one of the first bracket and the second bracket such that the second bracket can be moved between a fixed position and a released position by moving the second bracket relative to the first bracket to attach the third rafter, through the first bracket, to the ridge beam.

67 Claims, 20 Drawing Sheets

VARIABLE PITCH CONNECTOR BRACKETS FOR USE IN ATTACHING SUPPORTING MEMBERS TO BEARING MEMBERS IN ROOFS

This application is a continuation-in-part of Ser. No. 09/690,466, filed Oct. 18, 2000, now abandoned.

BACKGROUND OF THE INVENTION

This invention relates to brackets. More particularly, this invention relates to brackets for connecting rafters to ridge boards.

Building a roof requires extensive labor to prepare the components for assembly and for erection. The time required is increased if the components have to be positioned and then assembled high in the air with little or nothing to support them. In addition, components such as rafters have to be located with great accuracy in order to have the roof surfaces plane and intersect properly.

One of the simplest roofs is the gable, an illustration of which is shown in FIG. 5 herein. At its center and highest elevation, the gable roof has a rectangular steel or wood ridge board that connects the two triangular gable ends of the roof along the long axis of the building. Connected to the ridge board on both sides at regular intervals (normally 16 or 24 inches on center) are rafters, typically rectangular wood or steel roof supporting members, the same size or smaller than the ridge board. Rafters are attached perpendicularly to the ridge and slope down the roof at some angle, called the "roof slope", in opposite directions, to intersect with the top of the building's exterior walls at opposite sides of the ridge. The distance between the outside edges of the two opposing top plates is referred to as the roof's "total span".

A triangle is created at the two ends of the gable roof, between the two top plates and the ridge board. Because the ridge board is normally centered on the roof, a vertical line dropped from the center of the ridge board perpendicular to the horizontal plane created by the two opposing top plates will form two identical right triangles. Each triangle has a base leg equal to one-half the roof's "total span". The angle created between the horizontal plane of the two top plates and the hypotenuse of each triangle is the roof slope. The vertical distance between this horizontal plane and the theoretical point of intersection of the two opposing rafters is known as the "total rise" of the roof. The horizontal distance from the outside edge of either top plate to the point perpendicular and directly below the point of intersection of the two opposing rafters is known as the "total run" of the roof. The roof's "total run" is equal to one-half the roof's "total span". The "roof pitch" is the slope of the roof expressed as the ratio of the "total rise" to the "total run", and is usually shown as a whole number of inches of "total rise" to 12 inches of "total run".

For any set of plans, the designed roof pitch is specified and the "total run" is determined from the plan dimensions. From this information, the theoretical length of the rafters (the hypotenuse) can be calculated.

FIG. 5 shows the typical rafter installation using current assembly techniques. The calculated theoretical rafter length is different from the actual rafter length because the top surface of the rafter does not intersect the outside of the top plate. Instead, the rafter typically has a cut (i.e., "bird's mouth") which extends horizontally from the bottom surface of the rafter to provide a surface for the rafter to rest on and be secured to the top plate. Thus, the actual line the hypotenuse follows is from the intersection of the two opposing rafters through the body of the rafter to the intersection of the "bird's mouth" and the outside of the top plate. Depending on the length and size of the rafter, the height of the rafter's top surface above the top plate and the steepness of the roof, the actual pitch of the roof would be considerably different from the designed roof pitch.

Using the current assembly techniques, the top of the rafter is marked with the first ridge plum line (based on the designed roof pitch). An adjustment to the theoretical length of the rafter is then manually applied at the first ridge plum line to compensate for the thickness of the ridge board. A second ridge plum line is then marked at this adjustment point on the rafter. From the first ridge plum line, the calculated theoretical rafter length is then applied to the rafter. A heel plum line is marked at the end of the applied rafter length measurement. A horizontal seat cut line is then determined and marked on the rafter to intersect with the heel plum line.

Once the markings are applied to the rafter, the rafter is cut at the second ridge plum line and the heel plum line. The heel plum line is cut from the bottom surface of the rafter along the heel plum line to the intersection with the horizontal seat cut line. The horizontal seat cut line is then cut horizontally from the bottom surface of the rafter to the intersection with the heel plum line.

All of the cuts along the aforementioned marked lines are cut manually at the job site. As indicated in the discussion above, however, the layout and cutting of rafters requires considerable expertise and time. Thus, the accurate placement of the rafters, using the current assembly techniques, is completely dependent on the skill, care and knowledge of the carpenter building the roof. Small compounded errors in measuring, the width of the markings, the kerf size of the saw blade, the accuracy of the saw cut line, and the like, can all accumulate to cause significant variations between each finished rafter. Thus, it is desirable to provide a means for attaching rafters to ridge boards, the accuracy for which does not rely solely on the skill of the carpenter. In particular, it would be desirable to provide a means for attaching rafters to ridge boards which does not require on-site cutting of the rafters.

Once the rafters have been cut, they are individually attached to the ridge board. The top of the rafter at the ridge plum line cut, is located at and fastened to the top edge of the ridge board. Because of variations in rafter lengths and the angle of the rafter's ridge plum line cuts caused by the lack of accuracy in the manual measurement and cutting steps, the rafters are positioned on the ridge by "eye" and then, based on visual observation, adjusted to create as level a plane as possible along the top surfaces of the rafters. The plane formed along the rafter top surfaces constitutes the roof surface.

As indicated above, the location and level of the roof surface plane totally depends on the accurate cutting and positioning of each rafter on the ridge board by the carpenter. When using the current assembly techniques, there is no mechanical means or calculated measurement that aids the carpenter during assembly. It is all done by "eye" based on experience. It would be desirable to provide a means for installing rafters which does not rely solely on visual observation for accurate installation.

Variable pitch connector brackets for attaching rafters to bearing members such as ridge boards have been used in the art. Reference is made, e.g., to U.S. Pat. Nos. 4,498,801 (Gilb et al.), 5,546,726 (Stalzer), 5,797,694 (Breivik), 5,004,369 (Young) and U.S. Pat. No. 5,230,198 (Callies).

Although many brackets of varying designs have been developed, they all use similar assembly techniques and have all attempted to provide an integrated support to the existing rafter/ridge connection, e.g., by attaching sheet metal, with nails or screws, to the upper portion of the rafter at the rafter's ridge plum line cut/ridge junction and then mechanically fastening the sheet metal, with nails or screws, to the ridge board. Thus, the rafter is integrated as an interdependent, mechanical link in the support mechanism designed to support the pre-existing, direct mechanical connection of the rafter to the ridge at the rafter's ridge plum line cut/ridge junction. Therefore, in the prior art, the bracket's pitch depends on the integration and attachment of the rafter to the bracket and to the physical joining of the surface of the rafter's ridge plum line cut against the side surface of the ridge board.

It would be desirable to provide a bracket for connecting one or more rafters to a ridge board wherein the bracket alone establishes and maintains the roof pitch, independent of the rafters' connection to the bracket. It would also be desirable to provide a bracket which eliminates any need to directly fasten the rafter and ridge together with nails or screws.

In accordance with the foregoing discussion, an object of this invention is to provide a means for attaching rafters to ridge boards which does not rely solely on the skill of the carpenter for accurate attachment.

A further object of this invention is to provide a means for attaching rafters to ridge boards which does not require on-site cutting of the rafters.

Another object of this invention is to provide a means for attaching rafters to ridge boards which does not rely on visual observation for accurate placement of the rafters.

A still further object of this invention is to provide a bracket for attaching rafters to ridge boards, wherein the bracket alone provides support of the rafter.

A further object of this invention is to provide a bracket for attaching rafters to ridge boards wherein the bracket alone establishes and maintains the roof pitch, independent of the rafters' connection to the bracket.

Another object of this invention is to provide a bracket for attaching rafters to ridge boards, wherein the bracket eliminates any need to directly fasten the rafter(s) and ridge together with nails or screws.

Yet another object of this invention is to provide a bracket for attaching rafters to ridge boards wherein the bracket satisfies the foregoing objects.

These and/or other objects may be achieved in the present invention.

BRIEF DESCRIPTION OF THE DRAWINGS

In the drawings, like reference numerals represent similar parts of the illustrated embodiments of the present invention throughout the several views and wherein.

DETAILED DESCRIPTION

Figure 2:
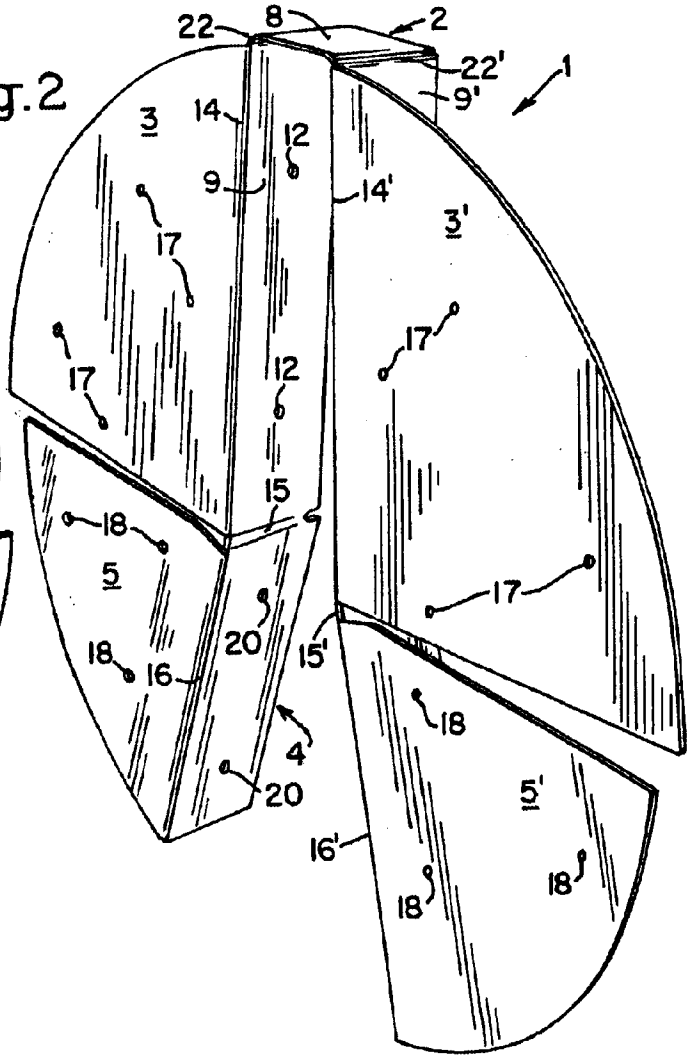
FIG. 2 is a perspective back view of the opposite side of the bracket shown in FIG. 1.

One embodiment of the present invention provides improved rafter-ridge connector brackets which allow the assembly of the roof rafter, utilizing different assembly techniques requiring only one measurement, while insuring a consistently accurate and level roof plane without the need for visual alignment by the carpenter to adjust or position the rafter. With the brackets of the embodiment, the designed slope of the roof becomes the actual slope of the roof. Each rafter can use the manufactured end cut provided by the material supplier with no additional cutting of the rafter required.

The embodiment provides variable pitch, dual- and mono-connector brackets for use in connecting supporting structural members to bearing members. Also, the embodiment provides variable pitch, dual- and mono-connector brackets for use in connecting rafters to ridge boards. The mono-connector brackets can also be used to attach such structural members as common rafters, hip rafters, valley rafters, hip jack rafters, hip valley cripple jack rafters, valley cripple jack rafters, and joists to such bearing members as ridge boards, hip rafters, valley rafters, ledgers, posts or studs.

The present invention is designed to solve problems encountered during the roof assembly process and to reduce the expertise, training and installation time required of the assembly crew. It further was designed to minimize crew-induced errors, during assembly, by simplifying, reducing and imparting greater accuracy to the mathematical computations and measurements required in the cutting and laying out of the rafters and the positioning of the rafters relative to the ridge board. This may be accomplished by establishing a fixed index for the rafter and ridge assembly. Specifically, by designing a connector bracket that incorporates a fixed index for the rafter's location relative to the ridge board, all rafters may plane automatically without adjustment. In addition, the ridge board may be automatically positioned correctly, both laterally (between the two top plates running parallel to the long axis of the roof) and vertically (at the proper height above the plate line). This may also reduce the rafter layout process, for example, to one simple measurement.

Fixed and movable side members of one or more brackets may overlap, when attached together, to provide a continuous mechanical connection at a fixed roof pitch.

The one or more brackets may establish and maintain the roof pitch and provide the support (e.g., at least substantial support) to the rafter, independent of a rafter's connection to the bracket(s). The bracket(s) can eliminate any need to provide physical contact between the rafter at the rafter's ridge plum line cut, and the ridge board, and can eliminate the need to directly fasten the rafter and ridge board together with nails or screws.

One embodiment of a variable pitch, dual-connector bracket may include: a base member configured for attachment to a bearing member, the base member having a top section for resting on a corresponding top section of the bearing member and first and second side sections for attachment to corresponding first and second side sections of the bearing member; first and second pivotable seat members configured for attachment to first and second structural support members, respectively; the first and second pivotable seat members being pivotally attached to the respective first and second side sections of said base member at respective first and second rafter index lines so as to be rotatable to varying pitch positions relative to the base member, wherein each rafter index line is constituted by an intersection of a bottom edge of the side section of the base member and a top edge of the pivotable seat member; first and second movable side members attached at 90° angles to the first and second pivotable seat members, respectively, so as to be capable of rotating with the pivotable seat members relative to the first and second side sections of the base member; and/or first and second fixed side members attached at 90° to the first and second side sections, respectively, of the base member and variably and overlappingly attached to the first and second movable side members so as to maintain the movable side members at a desired slope.

One embodiment of a variable pitch, mono-connector bracket may include: a base member configured for attachment to a bearing member, the base member having a top section for resting on a corresponding top section of the bearing member and a side section for attachment to a corresponding side section of the bearing member; a pivotable seat member configured for attachment to a structural support member, the pivotable seat member being pivotally attached to the side section of said base member at a rafter index line so as to be rotatable to varying slopes relative to the base member, wherein the rafter index line is constituted by a bottom edge of the side section of the base member and a top edge of the pivotable seat member; a movable side member attached at a 90° angle to the pivotable seat member so as to be capable of rotating with the pivotable seat member relative to the side section of the base member; and/or a fixed side member attached at a 90° angle to the side section of the base member and variably and overlappingly attached to the movable side member so as to maintain the movable side member at a desired slope.

One embodiment of a bearing member/support member/bracket assembly may include: the variable pitch, dual-connector bracket; a bearing member attached to the base member of the bracket, such that the top section of the base member rests on the corresponding top section of the bearing member and first and second side sections of the base member are attached to the corresponding first and second side sections of the bearing member; and/or first and second structural support members disposed in and attached to the first and second pivotable seat members, respectively, of the bracket, such that the bottom alignment edge of the bearing-member end of each structural support member is disposed adjacent to the corresponding rafter index line, the first and second pivotable seat members being positioned at a desired slope relative to the base member of the bracket.

Another embodiment of a bearing member/support member/bracket assembly may include: the variable pitch, mono-connector bracket; a bearing member attached to the base member of the bracket, such that the top section of the base member rests on a corresponding top section of the bearing member and the side section of the base member is attached to the corresponding side section of the bearing member; and/or a structural support member disposed in and attached to the pivotable seat member of the bracket such that the bottom alignment edge of the bearing-member end of the structural support member is disposed adjacent to the rafter index line, the seat member being positioned at a desired slope relative to the base member of the bracket.

The present invention also provides methods of using brackets to attach structural support members to bearing members.

One embodiment is directed to a method of attaching first and second structural support members to a bearing member, including the acts of: (1) providing the variable pitch, dual-connector bracket, wherein the first and second pivotable seat members have been pivoted to a desired slope and the first and second movable side members have been attached to the first and second fixed side members at overlapping fastening positions so as to maintain the desired slope; (2) attaching the base member of the bracket to the bearing member; and/or (3) attaching the first structural support member to the first pivotable seat member and the second structural support member to the second pivotable seat member, such that the bottom alignment edge of the bearing-member end of the first structural support member is disposed adjacent to the first rafter index line and the bottom alignment edge of the bearing-member end of the second structural member is disposed adjacent to the second rafter index line.

Another embodiment is directed to a method of attaching a single structural support member to a bearing member, including the acts of: (1) providing the variable pitch, mono-connector bracket, wherein the pivotable seat member has been pivoted to a desired slope and the movable side member has been attached to the fixed side member at one or more overlapping fastening positions so as to maintain the desired slope; (2) attaching the base member of the bracket to the bearing member; and/or (3) attaching the structural support member to the pivotable seat member such that the bottom alignment edge of the bearing-member end of the structural support member is disposed adjacent to the rafter index line.

The dual- and mono-connector brackets can allow the elimination of practically all of the rafter's or other structural support member's on-site cutting. Thus, with the use of the brackets, rafters or other structural support members can receive the necessary cuts at the material supplier and then be shipped to the site, thereby reducing installation time and minimizing on-site measuring and cutting errors.

In addition, the brackets may be adjustable to a wide range of roof pitches and rafter depths and widths.

The dual- and mono-connector brackets may secure structural support members (e.g., rafters) to a bearing member (e.g., a ridge board) at slopes varying from 0° to about 90°. The mono-connector brackets may secure a single structural support member to a bearing member, while the dual-connector brackets may secure two structural support members to opposite sides of a bearing member.

The mono-connector bracket may be the same as the dual-connector bracket except that the mono-connector bracket may only have one pivotable seat member, one fixed side member, one movable side member, one base member side section and a base member top section which can be as long or partially as long (e.g., ½ the length) as the base member top section used in the dual-connector bracket.

In FIGS. 1–4, the dual-connector bracket is represented by the reference numeral 1. Bracket 1 includes a base member 2, fixed side members 3 and 3', pivotable seat members 4 and 4', and movable side members 5 and 5' attached to respective pivotable seat members 4 and 4'. Base member 2 is shaped for attachment to a ridge board 6, and pivotable seat members 4 and 4' are configured for supporting rafters 7 and 7', respectively, and for connecting the rafters to ridge board 6 (see FIGS. 3 and 4).

Base member 2 includes a top section 8 and side sections 9 and 9'. Top section 8 is configured to fit over a corresponding top section 10 of ridge board 6, while side sections 9 and 9' of base member 2 are configured for attachment to corresponding side sections 11 and 11' of ridge board 6. Side sections 9 and 9' of base member 2 may be formed with fastener openings 12 adapted for receipt therethrough of fasteners 13 (see, for example, FIG. 4), such as, for example, nails or screws, for attachment to respective side sections 11 and 11 ' of ridge board 6 (see FIGS. 3 and 4).

Fixed side members 3 and 3' of bracket 1 may be integrally attached to respective side sections 9 and 9' of base member 2. Preferably, fixed side member 3 and side section 9 may be joined at a common side edge 14 which constitutes a rear side edge of side section 9 and an inner edge of side member 3. Similarly, fixed side member 3' and side section 9' may be joined at a common side edge 14' which constitutes a rear side edge of side section 9' and an inner edge of side member 3'.

Fixed side members 3 and 3' may be disposed at 90° angles relative to side sections 9 and 9'.

Pivotable seat members 4 and 4' of bracket 1 may be integrally attached to respective side sections 9 and 9' of base member 2. Pivotable seat member 4 may be pivotally joined to side section 9 at a common bend line 15 which constitutes a bottom bendable edge of side section 9 and a top bendable edge of pivotable seat member 4. Likewise, pivotable seat member 4' may be pivotally joined to side section 9' at a common bend line 15' which constitutes a bottom bendable edge of side section 9' and a top bendable edge of pivotable seat member 4'. Common bend line 15 and common bend line 15' may be "rafter index lines" for respective rafters 7 and 7'.

Movable side members 5 and 5' may be disposed at 90° angles relative to pivotable seat members 4 and 4'.

Movable side members 5 and 5' may be integrally attached to respective pivotable seat members 4 and 4'. As the pivotable seat members are pivoted about common bend lines 15 and 15', movable side members 5 and 5' may move with their respective pivotable seat members. Movable side member 5 may be joined to pivotable seat member 4 via common side edge 16 which is constituted by a rear side edge of the pivotable seat member 4 and an inner edge of movable side member 5. Also, movable side member 5' may be joined to pivotable seat member 4' via a common side edge 16' which is constituted by a rear side edge of the pivotable seat member 4' and an inner edge of movable side member 5'.

Fixed side members 3 and 3' and movable side members 5 and 5' may be formed with openings 17 and 18, respectively, for receipt therethrough of fasteners 19 (see, for example, FIG. 3), such as, for example, nails or screws, for attachment of the fixed and movable side members to the rafter and, consequently, to one another. The fixed side members and the movable side members may be attached to one another in overlapping fashion. The movable side members may be disposed on the outside and the fixed side members may be disposed on the inside (see FIG. 3). The specific degree of the overlap may depend on the desired pitch of the rafters. Fastener openings 17 in fixed side members 3 and 3' may be disposed in varying locations so as to allow the fixed and movable side members to be placed in the positions that will yield the desired pitch.

Pivotable seat members 4 and 4' may include openings 20 formed therein for receipt therethrough of fasteners 21 (see, for example, FIGS. 3 and 4) such as, for example, nails or screws, which attach pivotable seat members 4 and 4' to respective rafters 7 and 7'.

The brackets may be produced on progressive die forming equipment. The brackets may be stamped from pre-cut, light gauge, galvanized steel sheet having a thickness sufficient to provide the greatest possible strength for the required use. The sheet metal may have a thickness of from about 16 to about 22 gauge (i.e., about 54 to about 26 mils).

The bracket may be made from a flat shape and stamped so that one section is turned 90° from the main plane of the bracket. Appropriate holes may be placed to facilitate the connection of the bracket to the supporting members and the bearing members, for example, with nails or screws. The shape may also be modified so that the split, rounded side members on each end of the flat stock are moved on opposite sides and the 90° flange that was created, is formed into a "U" shape of appropriate size to fit over the bearing member. Each of the rounded sections is now on opposite sides of the bearing member and allows the supporting members from each side of the roof to be placed, and fastened, directly opposite one another.

At the manufacturer, base member 2 is bent, for example, along bend lines 22 and 22' to form side sections 9 and 9', respectively; fixed side members 3 and 3' are bent along common edges 14 and 14' at 90° angles relative to side sections 9 and 9' of base member 2; and movable side members 5 and 5' are bent along common edges 16 and 16' at 90° angles relative to pivotable seat members 4 and 4'. Pivotable seat members 4 and 4' may be pre-bent at the manufacturer to accomplish easy movement to the rafter pitch desired. Pivotable seat members 4 and 4' may be bent along common bend lines 15 and 15', respectively, to form angles between the pivotable seat members 4 and 4' and the respective side sections 9 and 9' of base member 2 that will yield the desired pitch. The angles between the pivotable seat members 4 and 4' and side sections 9 and 9', which can be the same or different, typically will have a value sufficient to provide a rafter slope of from 0° to about 90°. Typically, roof pitches range from 3/12 to 14/12, although greater and lesser pitches can be set with the brackets.

Figure 3:
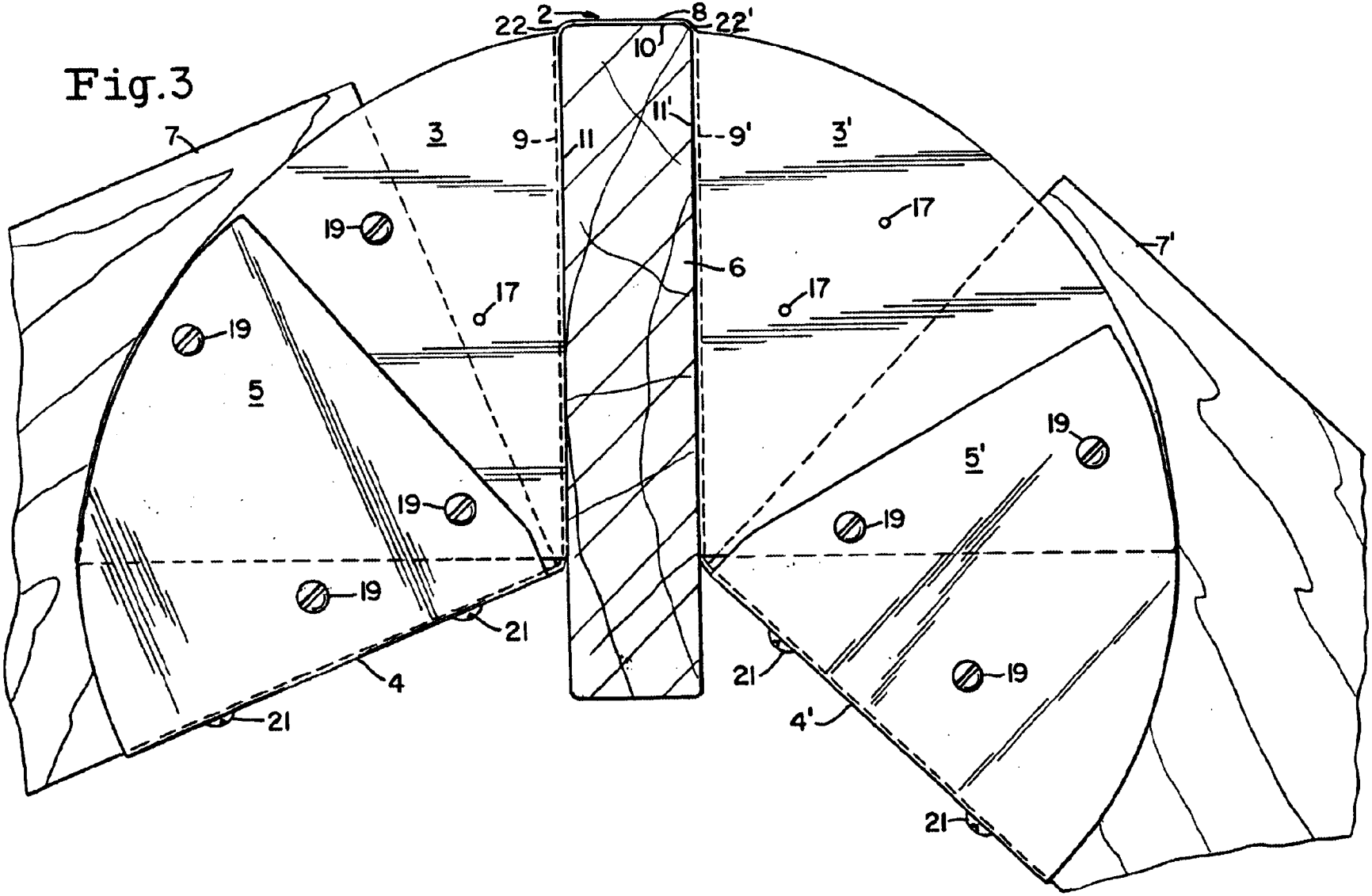
FIG. 3 is an end view of the FIG. 2 bracket shown in place, attached to a ridge board with rafters attached; one of the rafters being attached at a 12/12 pitch (12 inches of total rise to 12 inches of total run) and the other rafter being attached at a 6/12 pitch (6 inches of total rise to 12 inches of total run), for illustrative purposes.
Figure 4:
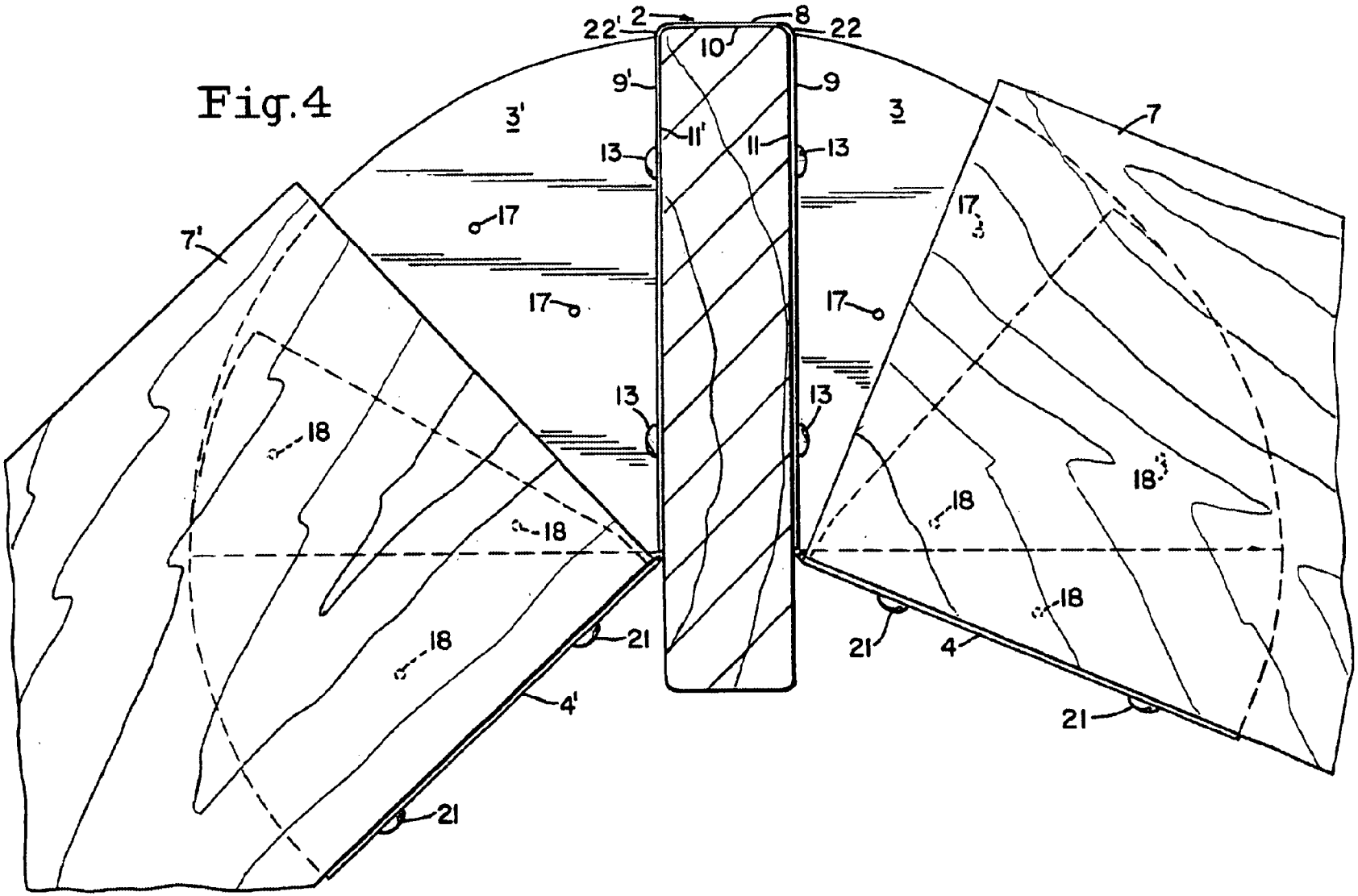
FIG. 4 is an opposite end view of the assembly shown in FIG. 3.
Figure 5:
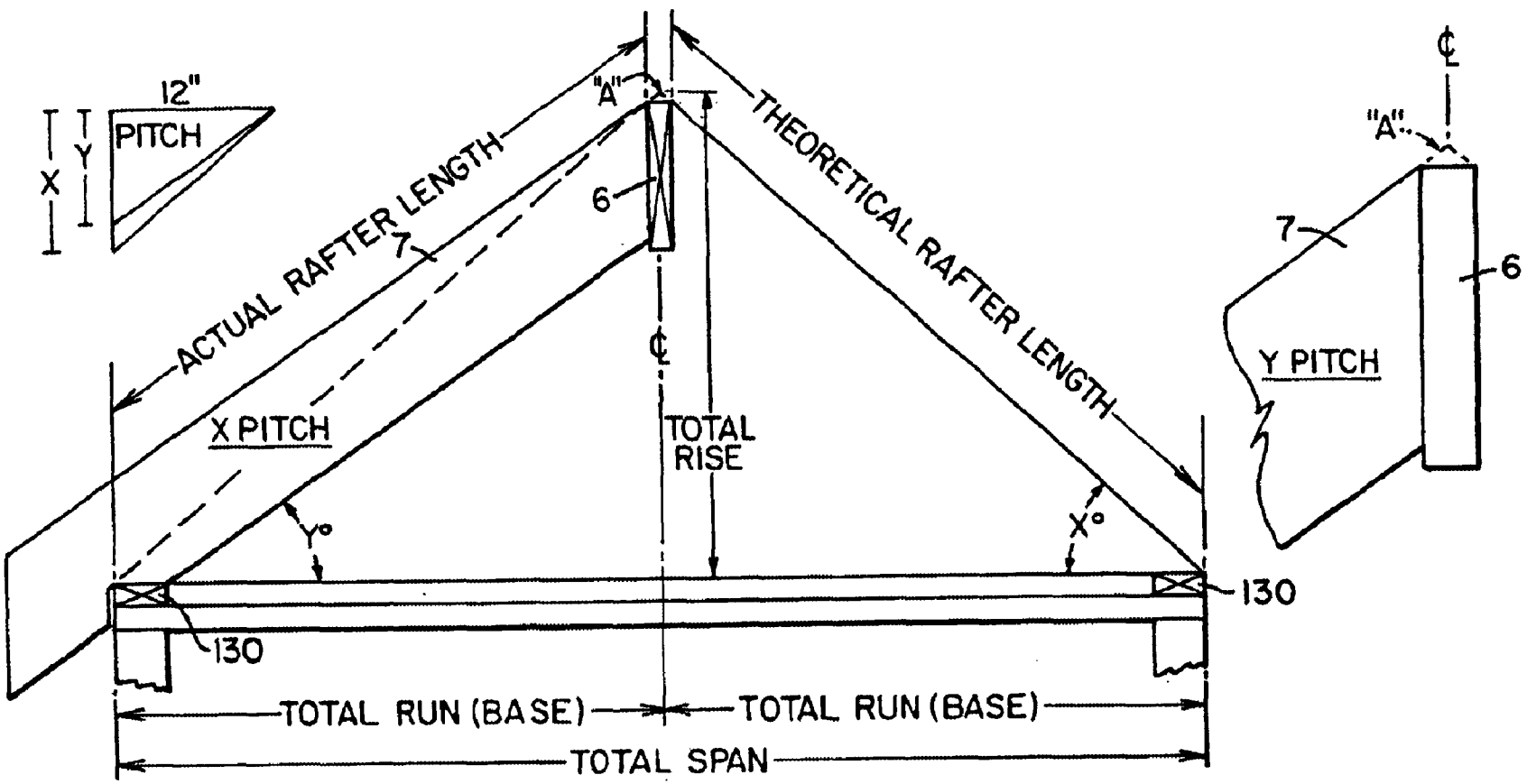
FIG. 5 is an illustration of a typical gable roof/rafter construction using current assembly techniques.

FIGS. 3 and 4 show the use of bracket 1 to attach rafters 7 and 7' to ridge board 6. The dual connector bracket may be attached to the ridge board prior to installation of the rafters. Also, prior to its attachment to the ridge board, the bracket may be adjusted so that the pivotable seat members 4, 4' are disposed at the desired roof pitch. During such adjustment of the bracket, as the movable side members 5 and 5' are rotated to the desired roof pitch position, the respective planes of the movable side members move behind the corresponding fixed side members 3 and 3' and provide an overlap of the fixed and movable side members. Such overlap is beneficial because once they are mechanically joined together, for example, with screws or nails, they create a supporting bracket that provides a continuous and fixed mechanical connection between the supporting and bearing members. Pre-positioned holes, pitch positioning lugs and/or markings allow for simple determination of the proper roof pitch and fast and easy attachment, for example, with nails or screws.

Base member 2 is attached to ridge board 6 so that top section 8 of base member 2 sits on the top section 10 of ridge board 6 and side sections 9 and 9' of the base member are attached to respective side sections 11 and 11' of the ridge board. Nails or screws 13 may then be nailed or screwed through openings 12 in the side sections 9 and 9' of base member 2 into respective side sections 11 and 11' of ridge board 6.

Rafters 7 and 7' are then placed on pivotable seat members 4 and 4', respectively. Nails or screws 21 may be nailed or screwed through openings 20 in the pivotable seat members into the rafters.

As stated previously herein, common bend lines 15 and 15' (i.e., the line at which side sections 9 and 9' and pivotable seat members 4 and 4' intersect, respectively) may constitute "rafter index lines". Each rafter index line constitutes a fixed location on the bracket side sections which may remain a constant, factory-determined distance (the length of the side section) from the top of the ridge board, regardless of the width of the ridge board or the roof pitch. The bottom alignment edge of each rafter may be positioned at the rafter index line. The bottom alignment edge is the edge created by the intersection of the bottom surface of the rafter and the rafter's end surface for that end of the rafter positioned at the ridge board. Thus, the top surface of each rafter may be located the same distance from the rafter index line and hence a constant distance from the top of the ridge board. This mechanically fixed distance may insure that every rafter is positioned the same distance from the top of the ridge board. This further may insure that, given the identical slope for each rafter, the top of each rafter will automatically fall in the same roof plane.

Figure 6:
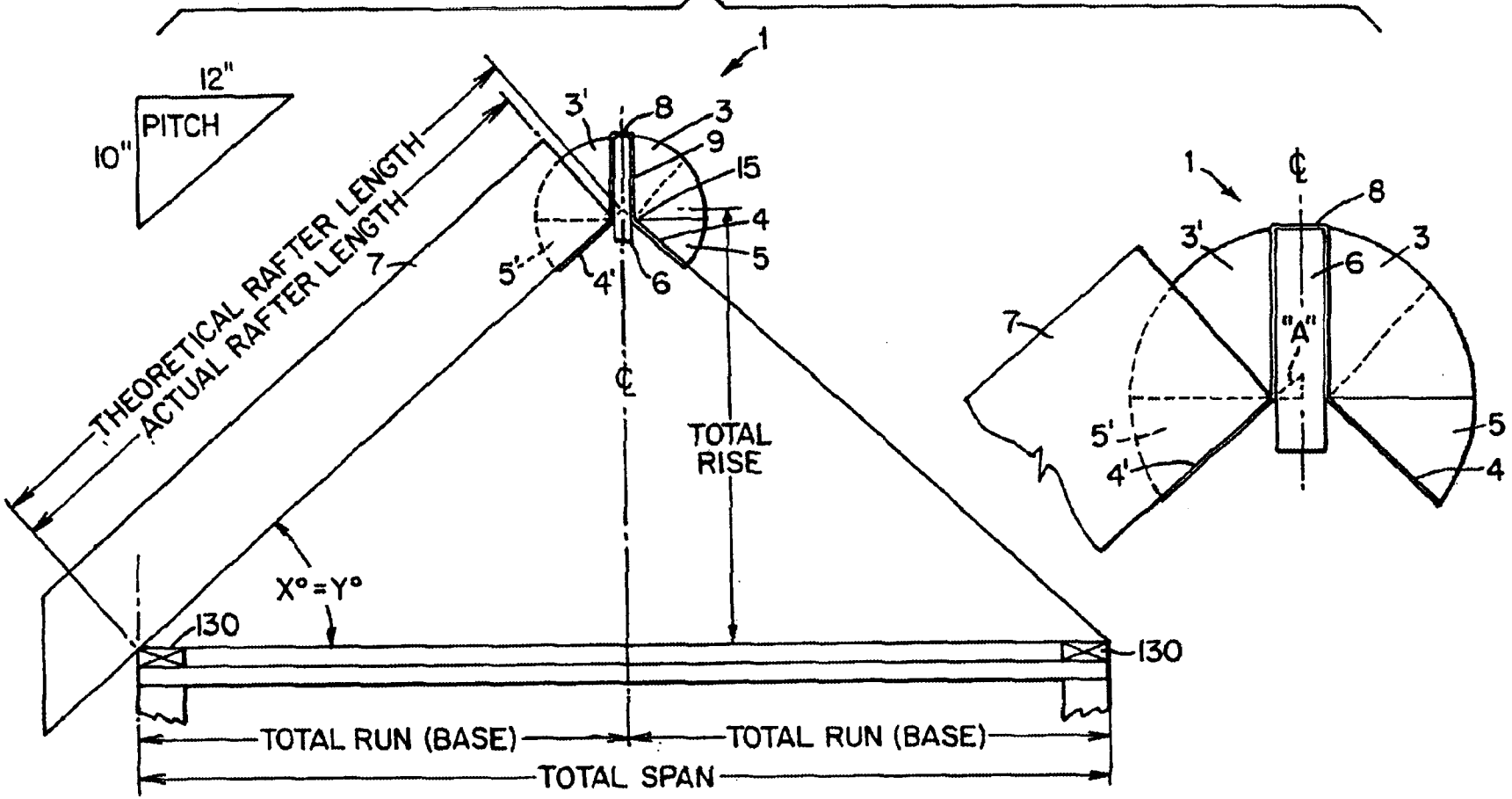
FIG. 6 is an illustration of a gable roof/rafter construction using a bracket within the scope of this invention.

The point of intersection of the rafter and the outside edge of the top plate (see FIG. 6), called the heel plum line, may be determined by the theoretical rafter length, less an amount required to compensate for the thickness of the ridge board. This adjusted length is called the "actual rafter length". The theoretical rafter length is reduced by the length of the hypotenuse of a right triangle with a base angle equal to the roof slope and a base leg equal to one-half the thickness of the ridge board. The actual rafter length is then applied to the rafter, by measuring from the rafter's bottom alignment edge along the bottom surface. of the rafter to locate the heel plum line.

Once the dual connector brackets are attached to the ridge board and the heel plum line has been marked on all the rafters, the assembly of the roof can take place. The specific order of assembly is dependent on the particular roof to be assembled and the desires of the personnel doing the assembly. Two or more rafters may be attached to one side of the ridge to insure that each rafter's bottom alignment edge is properly positioned at the rafter index line of the dual connector bracket. The rafter's bottom surface is placed on the pivotable seat member and attached, for example, with screws or nails 21, through openings 20 of the bracket's pivotable seat member. The ridge board may be lifted and temporarily supported while two or more of the attached rafters are now adjusted and temporarily fastened such that the heel plum line mark of each rafter is properly positioned at the outside edge of the top plate. Additional rafters may be positioned and attached to the opposite side of the ridge board such that each rafter's bottom alignment edge is properly positioned at the dual connector bracket's rafter index line and is fastened, for example, with screws or nails 21 through openings 20 of the pivotable seat member of the dual connector bracket. These rafters are now positioned on the correct layout and adjusted and fastened to the top plate such that the heel plum line of each rafter is aligned with the outside edge of the top plate.

Once the alignment of the heel plum lines and the outside edge of the top plate is confirmed, the ridge may be adjusted along the roof's long axis to insure the perpendicular placement of the rafters relative to the ridge board and top plates. Once the ridge is correctly located, the rafter connections at the top plate can be made permanent and the dual connector bracket can be permanently fastened to each rafter, for example, with nails or screws 19, through openings 17 and 18 in the fixed side members and movable side members, respectively, of the dual connector bracket.

The ridge board is now accurately centered in the correct location and at the correct height, and the rafters on each side of the ridge are in the same roof plane. This accuracy and ease of assembly, for example, is the result of the mechanically fixed connection afforded by the design of the dual connector bracket.

The bearing members and supporting members with which the brackets can be used can be made of any suitable material such as, for example, metal, wood, plastic and/or an engineered composite material.

The brackets can be easily attached to the bearing member and/or supporting members prior to erection, thus making the assembly and erection of the roof system accurate, faster and safer.

To facilitate conversion of the dual-connector bracket into a mono-connector bracket, the bracket can be provided with a pre-stamped crease in the middle of the top section of base member 2 to allow for separation of the two bracket sides, without tools, for example, for those situations where only one bracket is required.

The connector brackets may be used to attach structural support members, e.g., common rafters, hip rafters, valley rafters, hip jack rafters, hip valley cripple jack rafters, valley cripple jack rafters and/or joists, to a bearing member, e.g., a ridge board, a hip rafter, a valley rafter, a ledger, a post and/or a stud.

A roof framing system may include a plurality of brackets that work together to simplify the roof framing process, improve the installation accuracy and to expedite its assembly.

Figure 14:
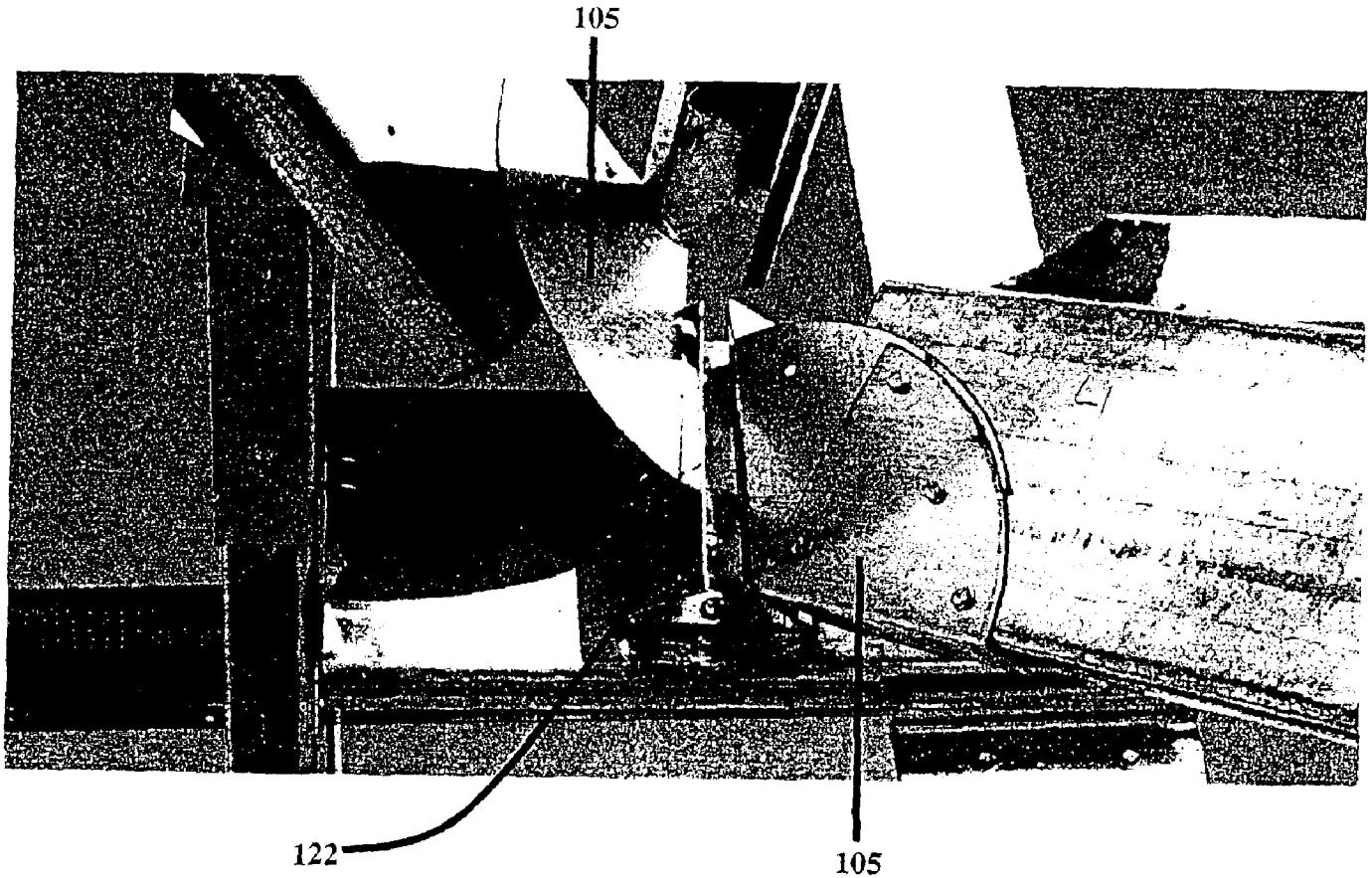
FIG. 14 is an illustration of one embodiment of a ridge hip without common bracket, attached to single rafter brackets.
Figure 15A:
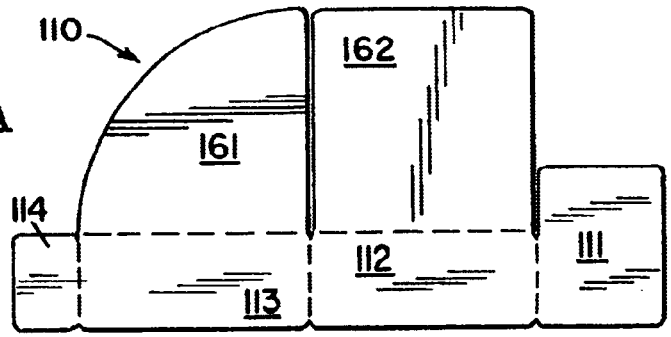
FIGS. 15A, 15B, 15C, and 15D are illustrations of a top view, a side view, a top view, and a side view, respectively, of one embodiment of a plate bracket.
Figure 15B:
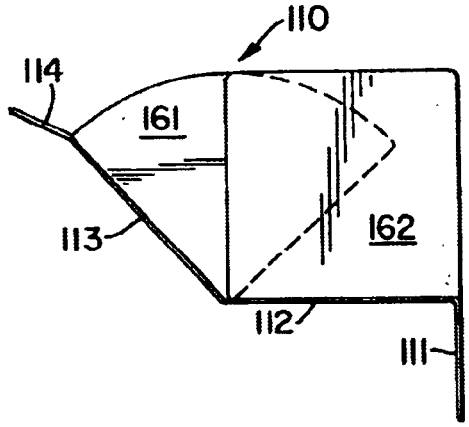
Figure 15C:
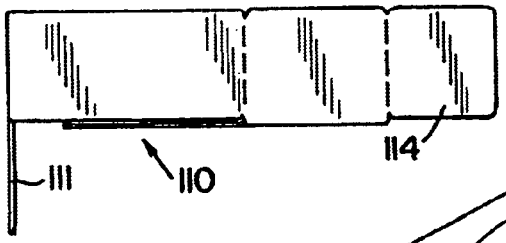
Figure 15D:
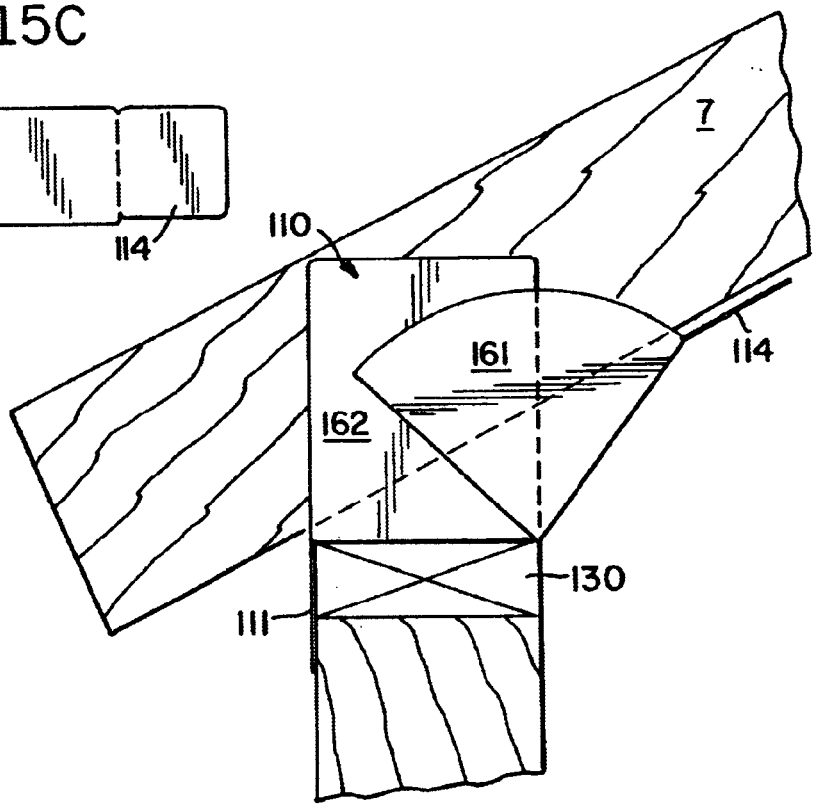
Figure 16:
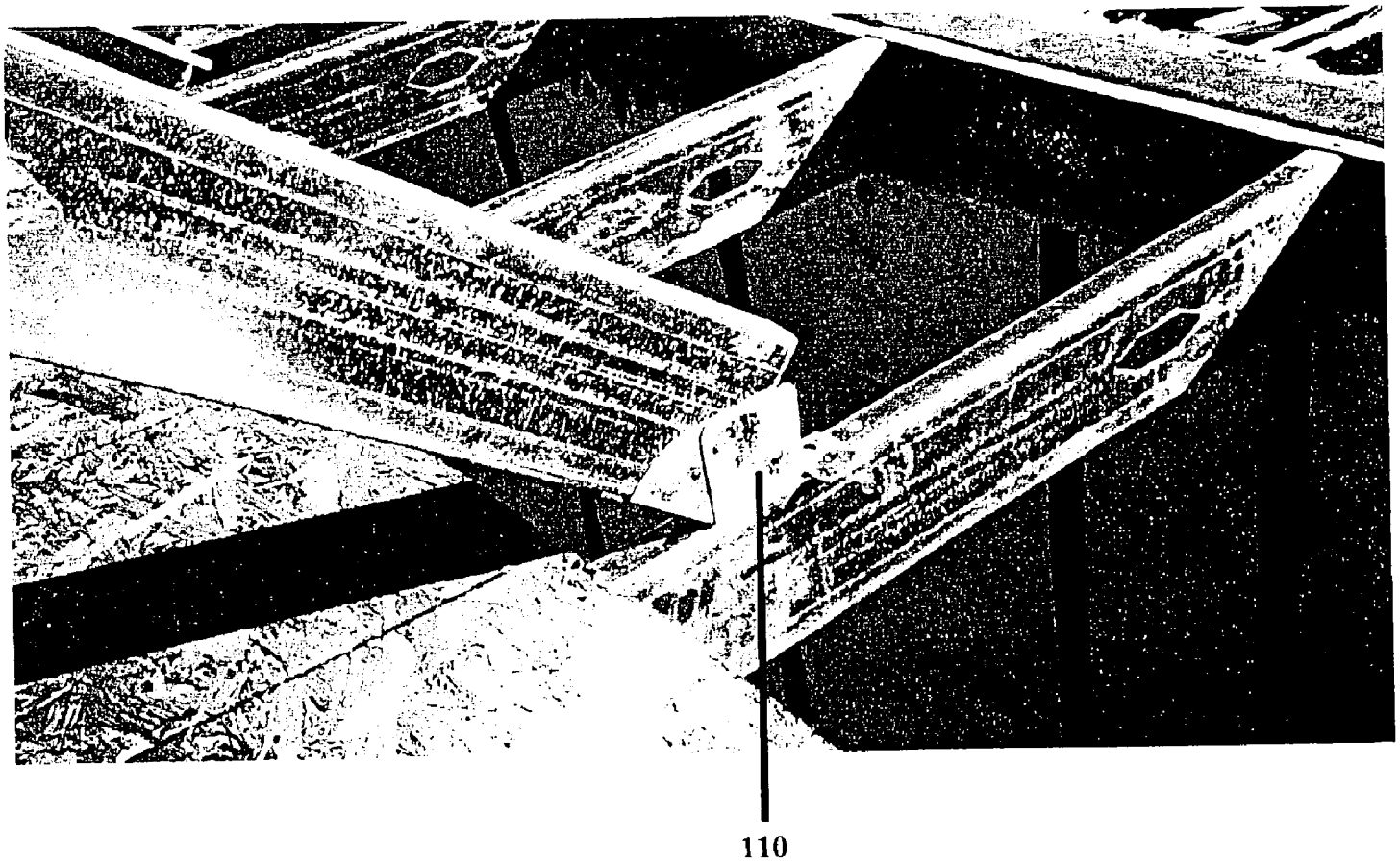
FIG. 16 is an illustration of one embodiment of a plate bracket.
Figure 18:
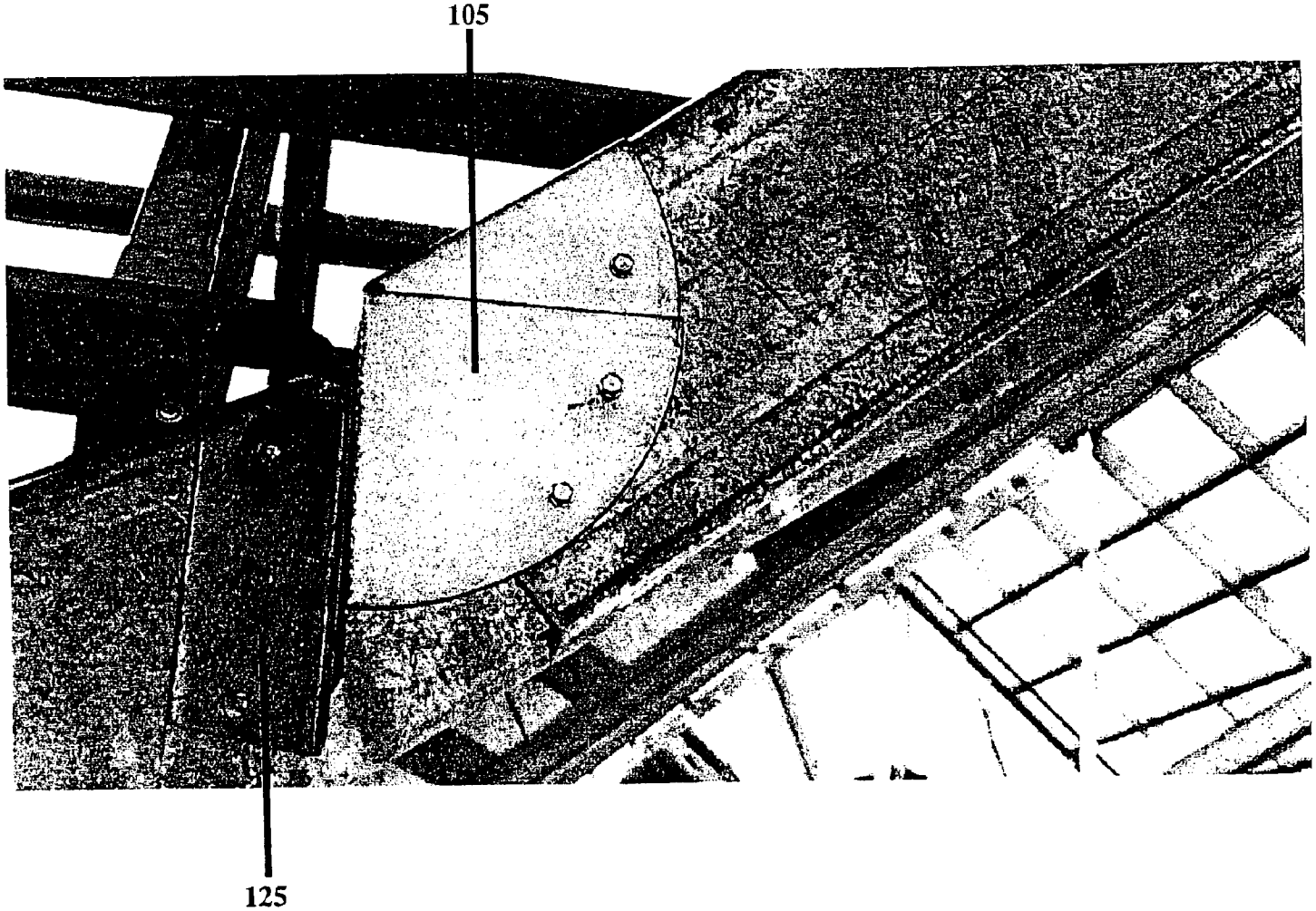
FIG. 18 is an illustration of one embodiment of a 45 degree bracket attached to one embodiment of a single rafter bracket.
Figure 19:
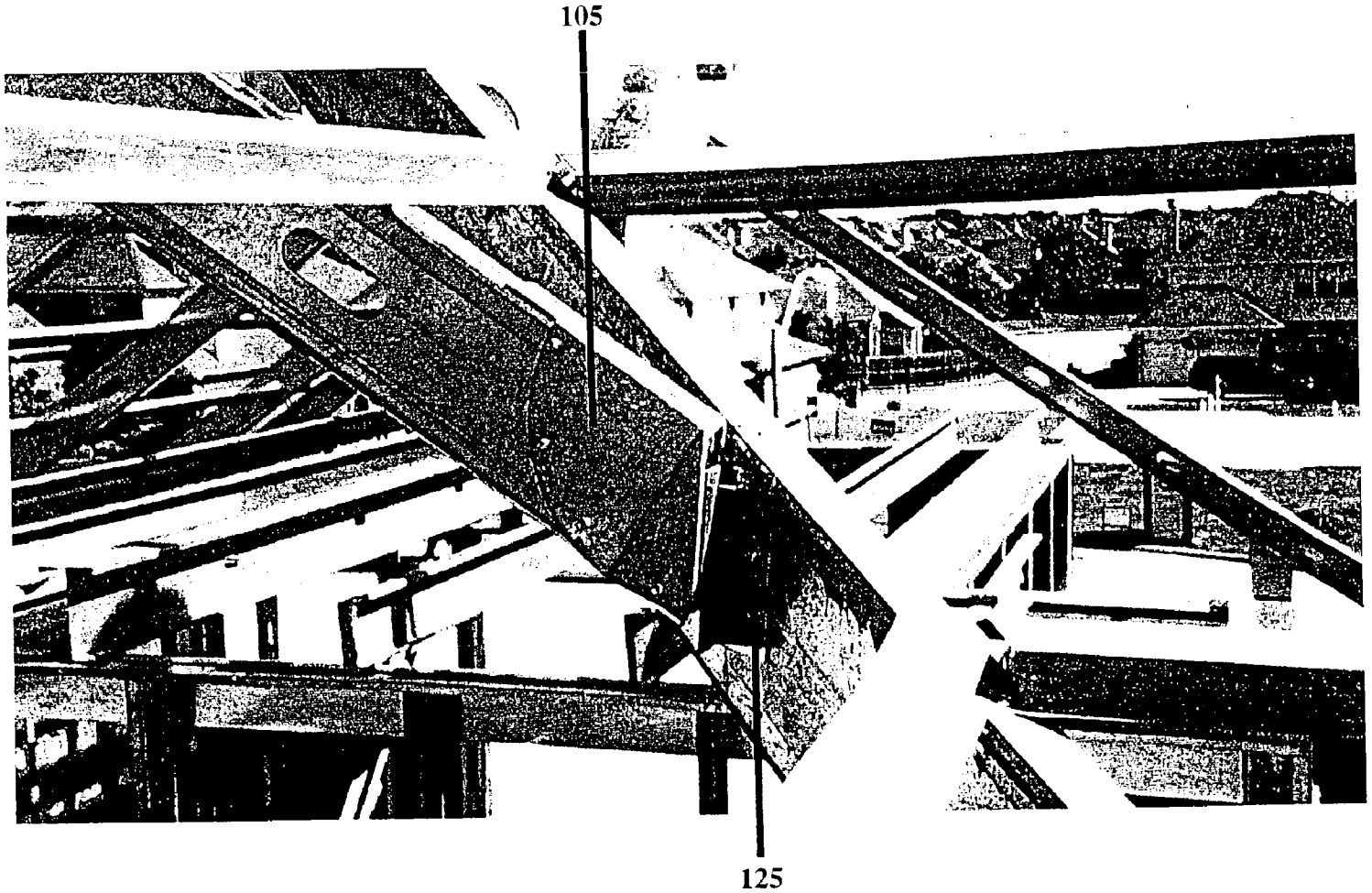
FIGS. 19–20 are similar to FIG. 18.
Figure 20:
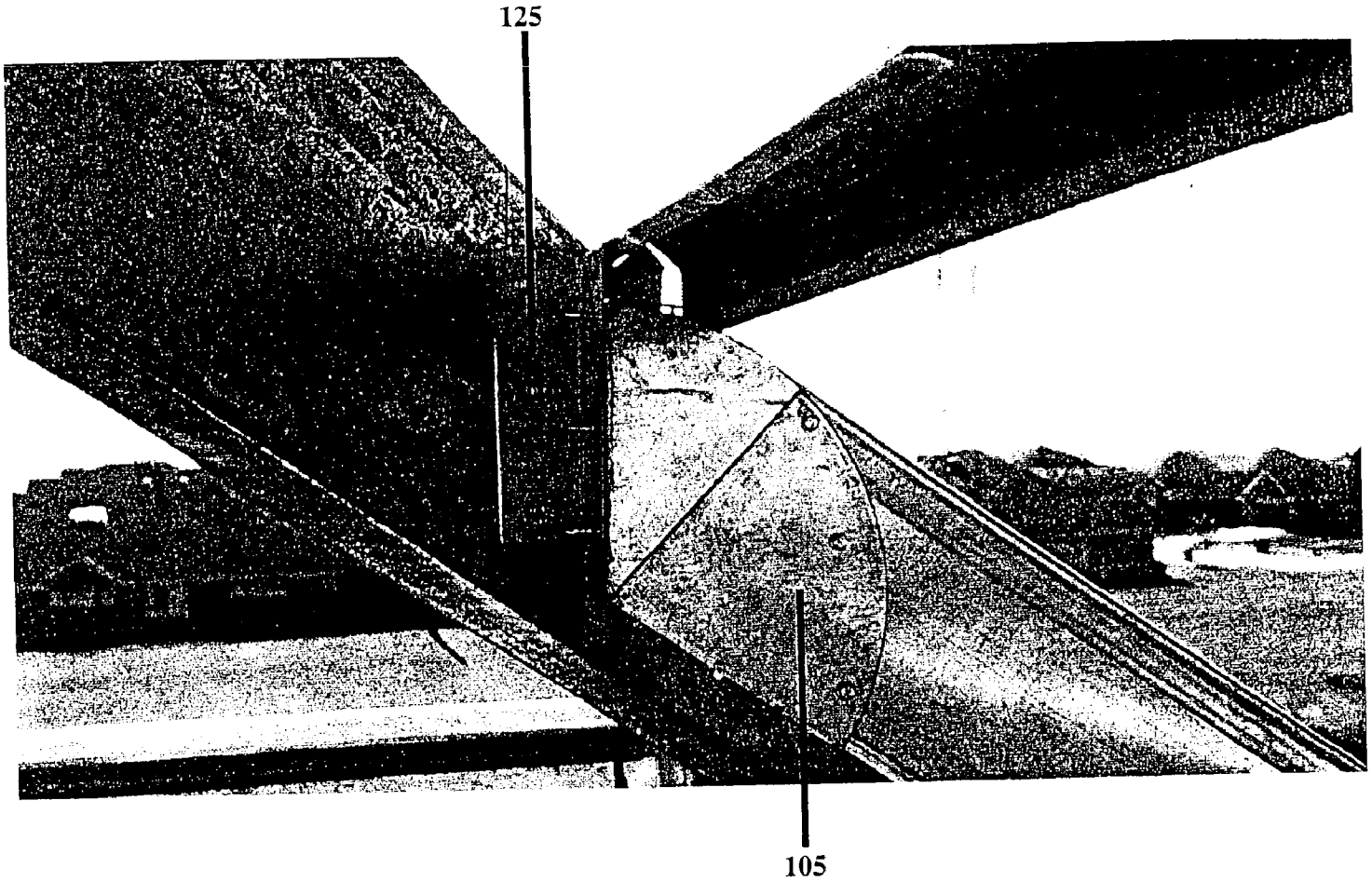
Figure 17A:
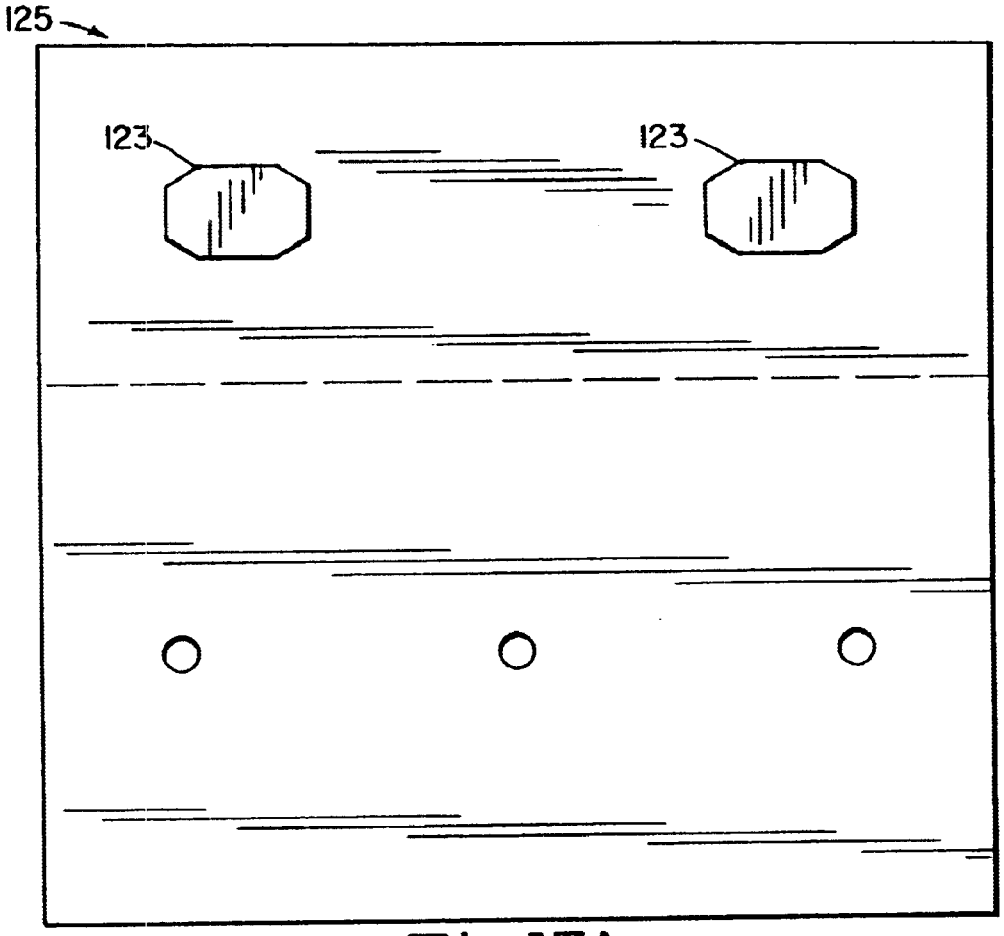
FIGS. 17A and 17B are illustrations of a side view and a top view, respectively, of one embodiment of a 45 degree bracket or a hip jack bracket.
Figure 17B:
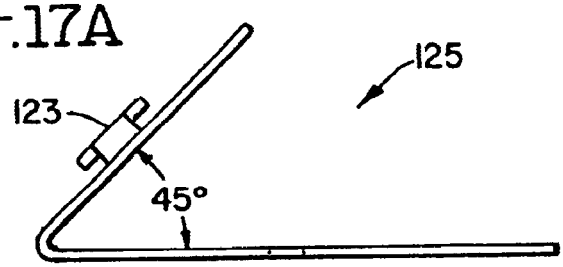
Figure 21A:
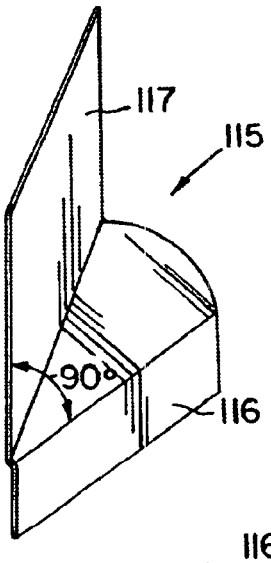
FIGS. 21A, 21B and 21C are illustration of a perspective view, a top view and a side view, respectively, of one embodiment of a hip plate bracket.
Figure 21B:
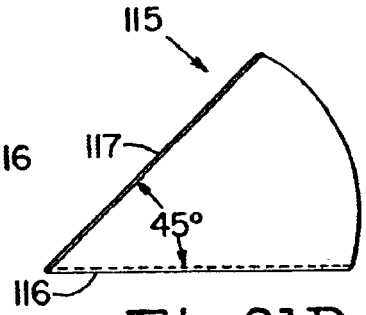
Figure 21C:
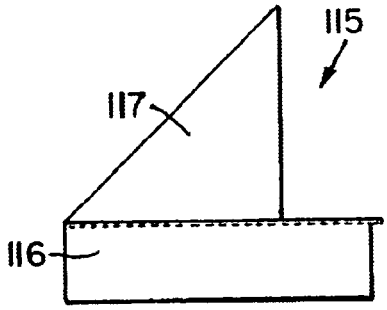
Figure 22:
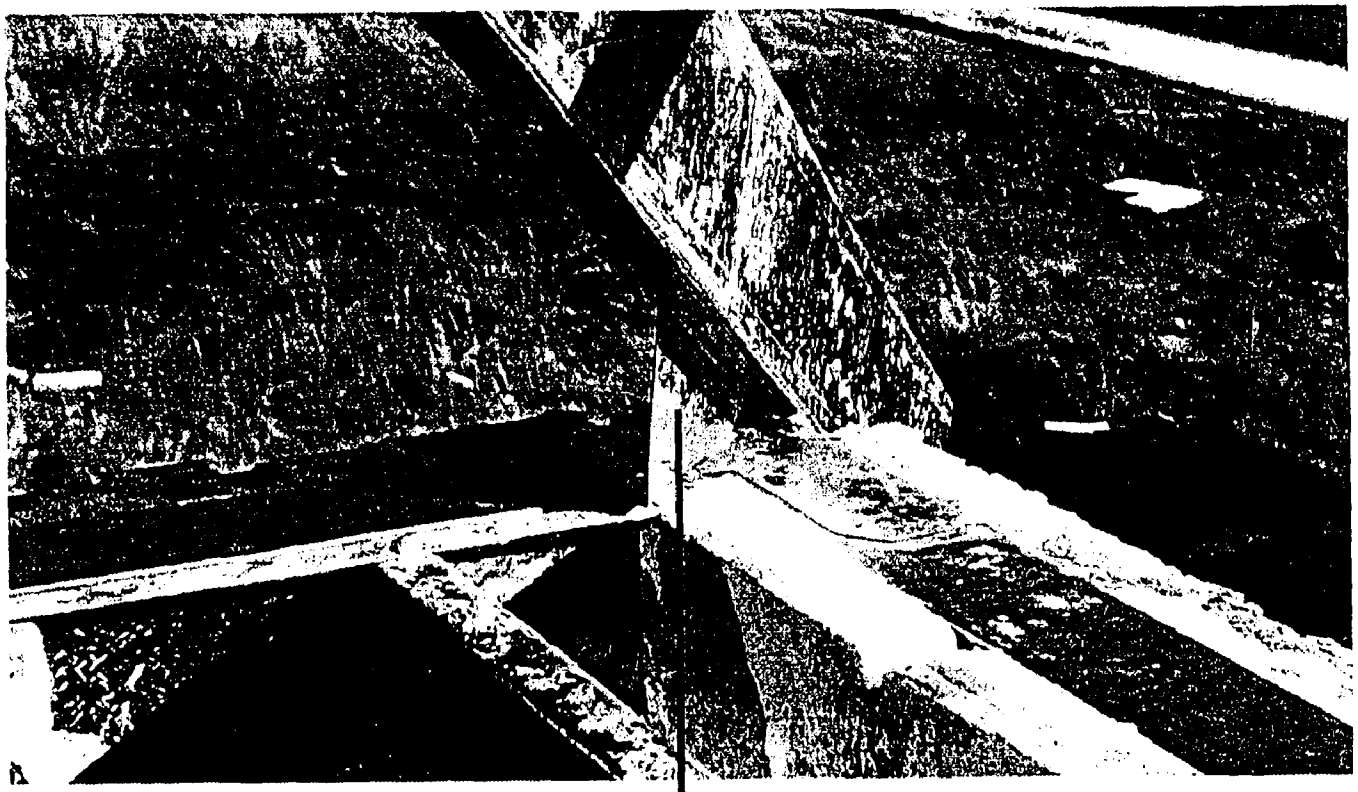
FIG. 22 is an illustration of one embodiment of a hip plate bracket.
Figure 23:
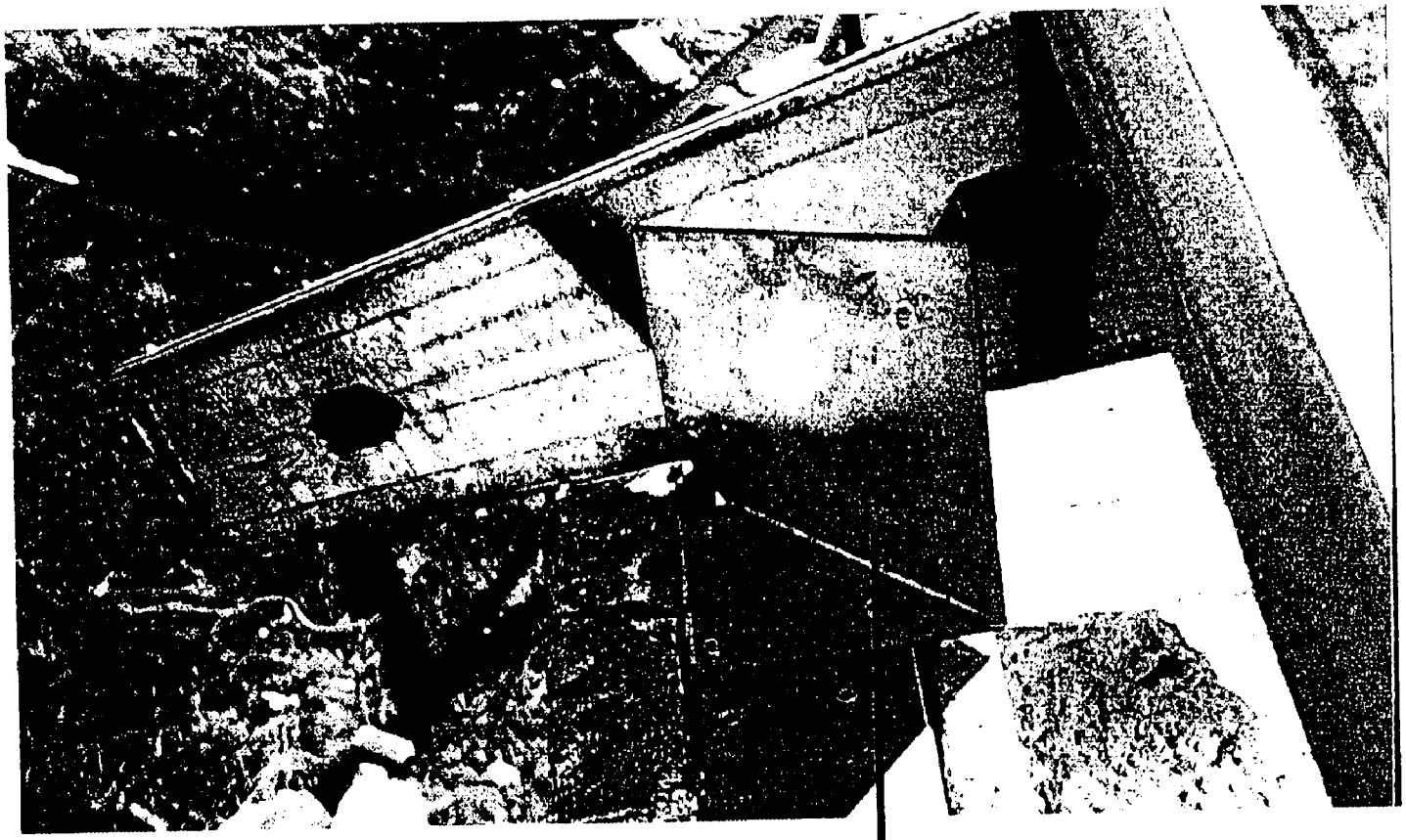
FIG. 23 is similar to FIG. 22.

A dual rafter bracket 1 (see, for example, FIGS. 1–4, 6–7, 11–12) may be separated into two individual, single rafter brackets 105 (see, for example, FIGS. 8, 10–14, 18–20) (which can be used in an inverted or non-inverted manner (see, for example, FIG. 14)). The dual and single rafter brackets may support a rafter as it joins a supporting and/or bearing member(s) such as, for example, a ridge beam, hip rafter and/or valley rafter. A plate bracket 110 (see, for example, FIGS. 15–16) may support and attach a rafter, for example, at the rafter's lower end to a top plate 130 of an exterior wall and/or other supporting and/or bearing member. A hip plate bracket 115 (see, for example, FIGS. 21–23) may attach, for example, the bottom of a hip or valley rafter at the top plate 130 of the exterior wall at the juncture of two exterior walls (e.g., corner). A ridge hip bracket 120 (see, for example, FIGS. 9–14) may transition the roof, for example, at the ridge where the hips join. A 45 degree bracket 125 (see, for example, FIGS. 17–20) allows a first supporting and/or bearing member to be attached, through the 45 degree bracket, to a second supporting and/or bearing member at an angle (e.g., approximately 45 degrees) relative the second supporting and/or bearing member. For example, the 45 degree bracket may be used with the single rafter bracket to attach jack rafters to hip and/or valley rafters, at the top and/or bottom of the jack rafter.

The ridge hip bracket, for example, may be configured in different ways. A first configuration allows for a center king common rafter attachment in the middle of the hip roof between the two hip rafters (see, for example, FIGS. 9–12). A second configuration provides an alternative transition at the ridge hip intersection that does not utilize a common rafter. The first two configurations may be designed to work in conjunction with the dual rafter bracket. A third (see, for example, FIG. 13) and fourth (see, for example, FIG. 14) configurations may be similar in purpose and design as the first and second, but stand alone at the end of the ridge and do not need the dual rafter bracket for attachment.

The uniqueness of this roof framing system may not just be in the shape and design of each individual bracket, but may also be in the way the brackets interconnect and/or compensate (e.g., automatically compensate) for required geometric adjustments. The system design may allow for greater flexibility while easily maintaining accuracy and ease of assembly.

Figure 1:
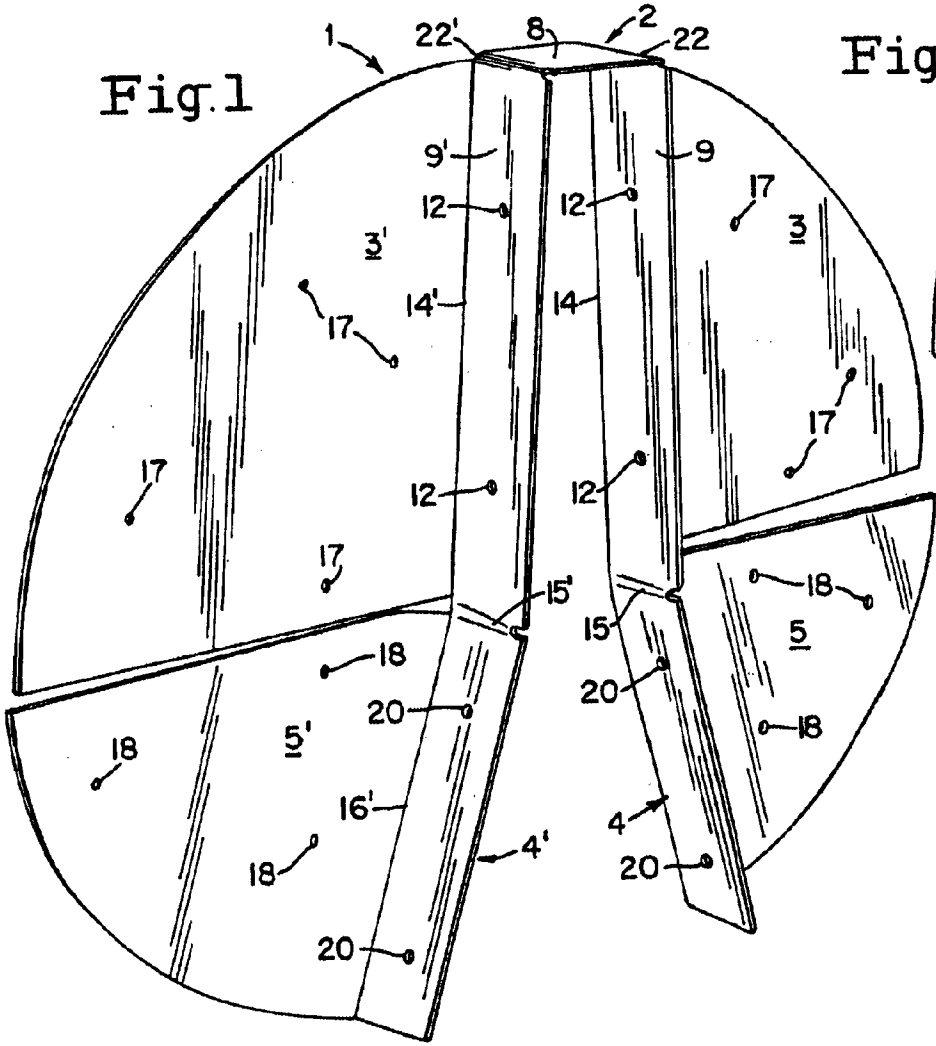
FIG. 1 is a perspective front view of one embodiment of a bracket before proper pitch bending.
Figure 7A:
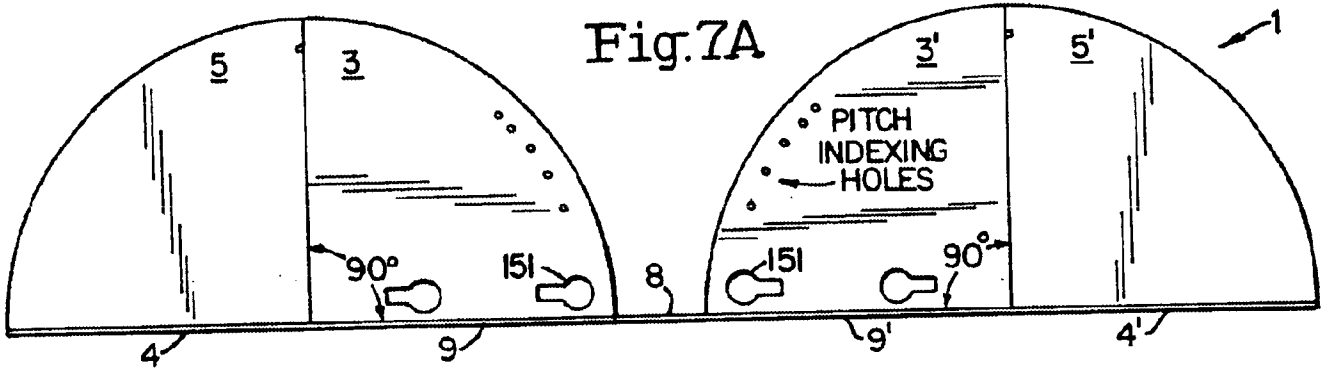
FIGS. 7A and 7B are illustrations of side views of one embodiment of a dual rafter bracket.
Figure 9A:
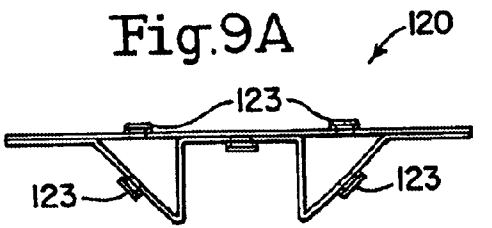
FIGS. 9A and 9B are illustrations of a top view and a side view, respectively, of one embodiment of a ridge hip bracket.
Figure 9B:
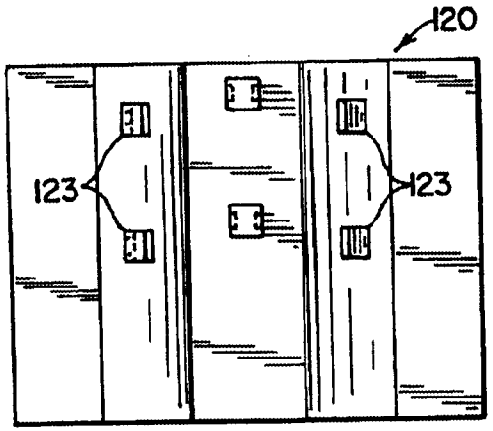
Figure 7B:
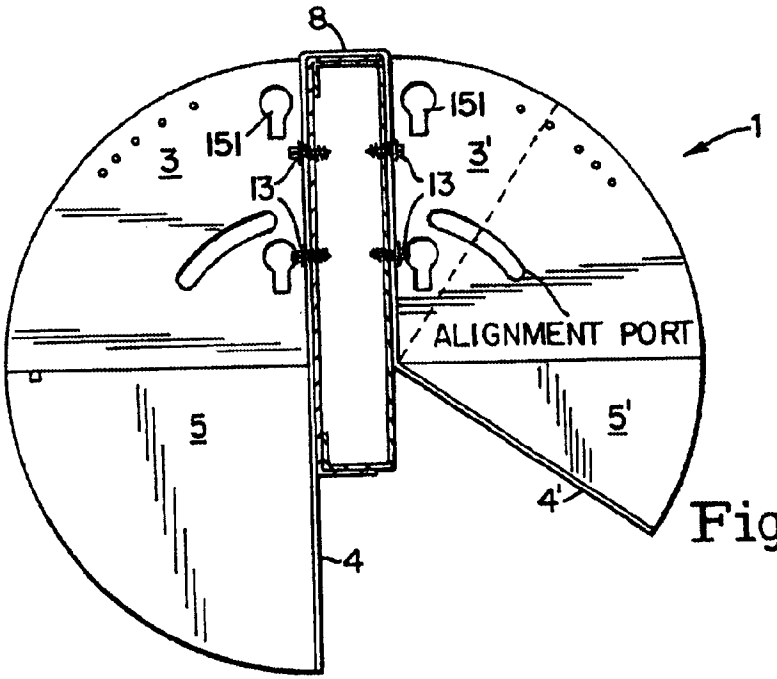
Figure 8A:
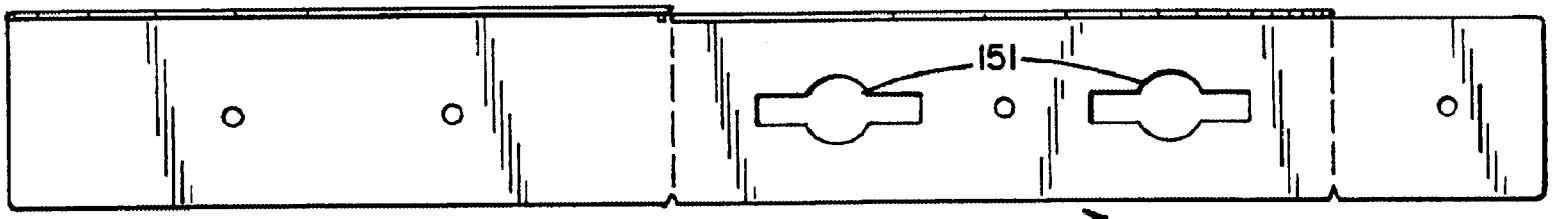
FIGS. 8A and 8B are illustrations of a top view and a side view, respectively, of one embodiment of a single rafter bracket.
Figure 8B:
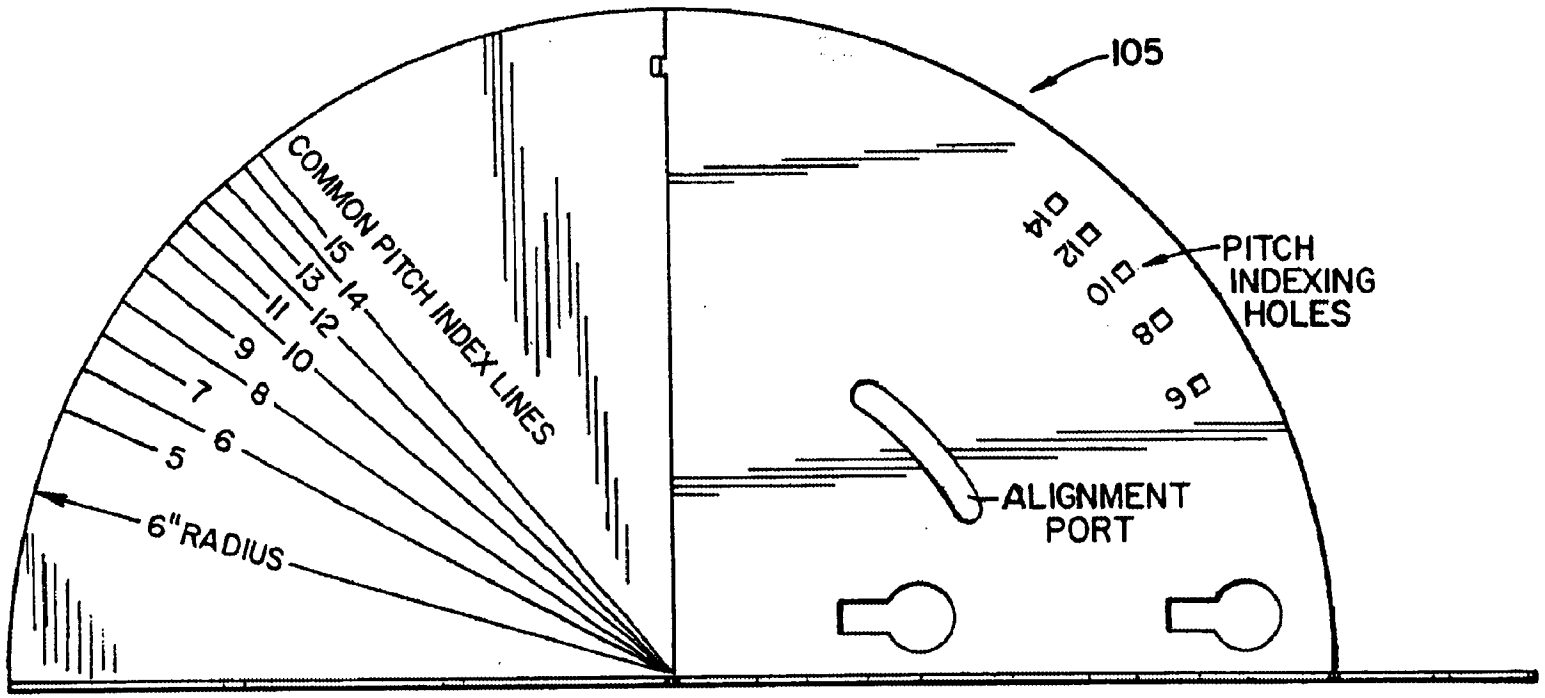
Figure 10:
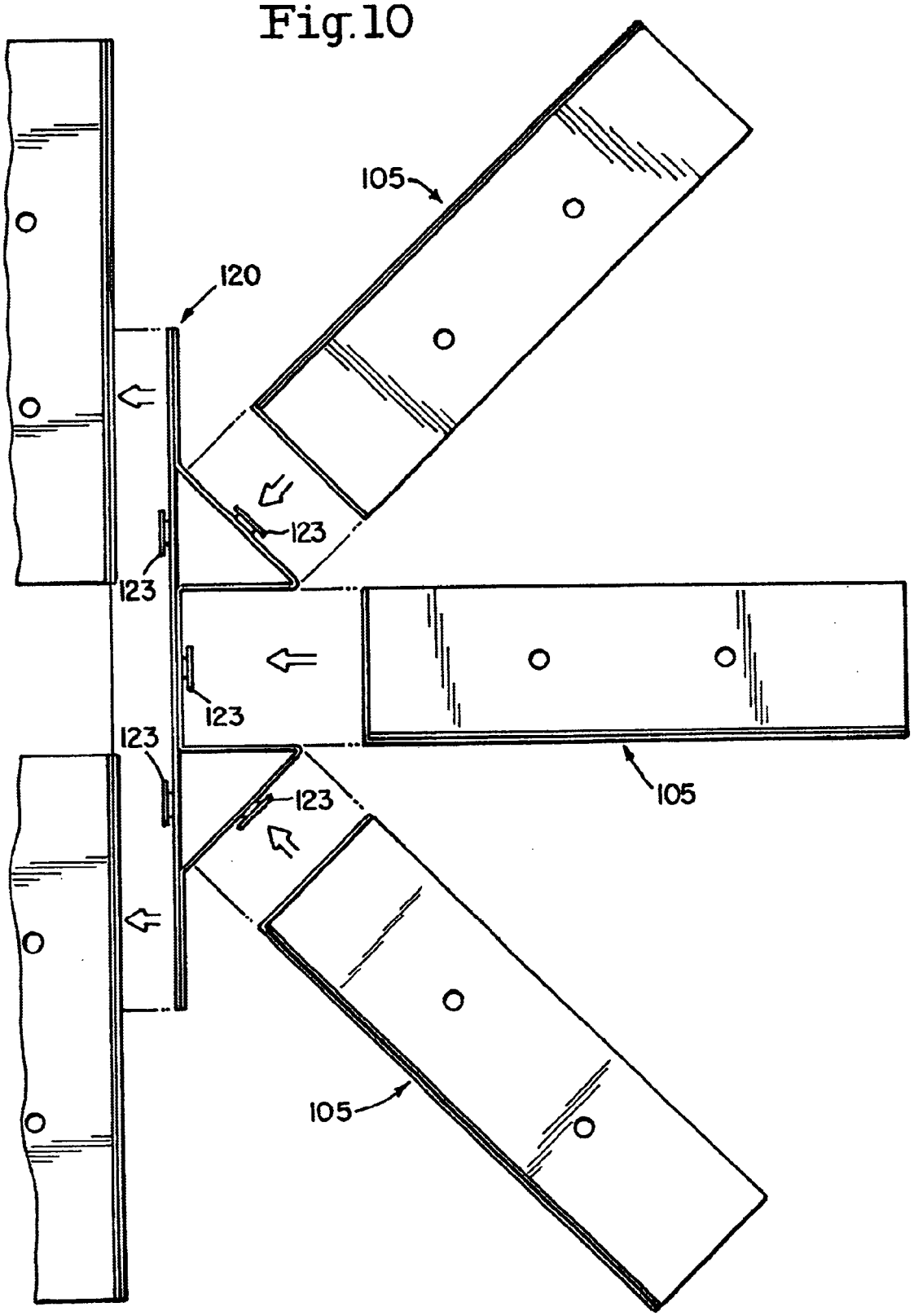
FIG. 10 is an illustration of one embodiment of a ridge hip assembly, where the ridge hip bracket is being moved toward the dual rafter bracket for installation, and also single rafter brackets are being moved toward the ridge hip bracket for installation.
Figure 11:
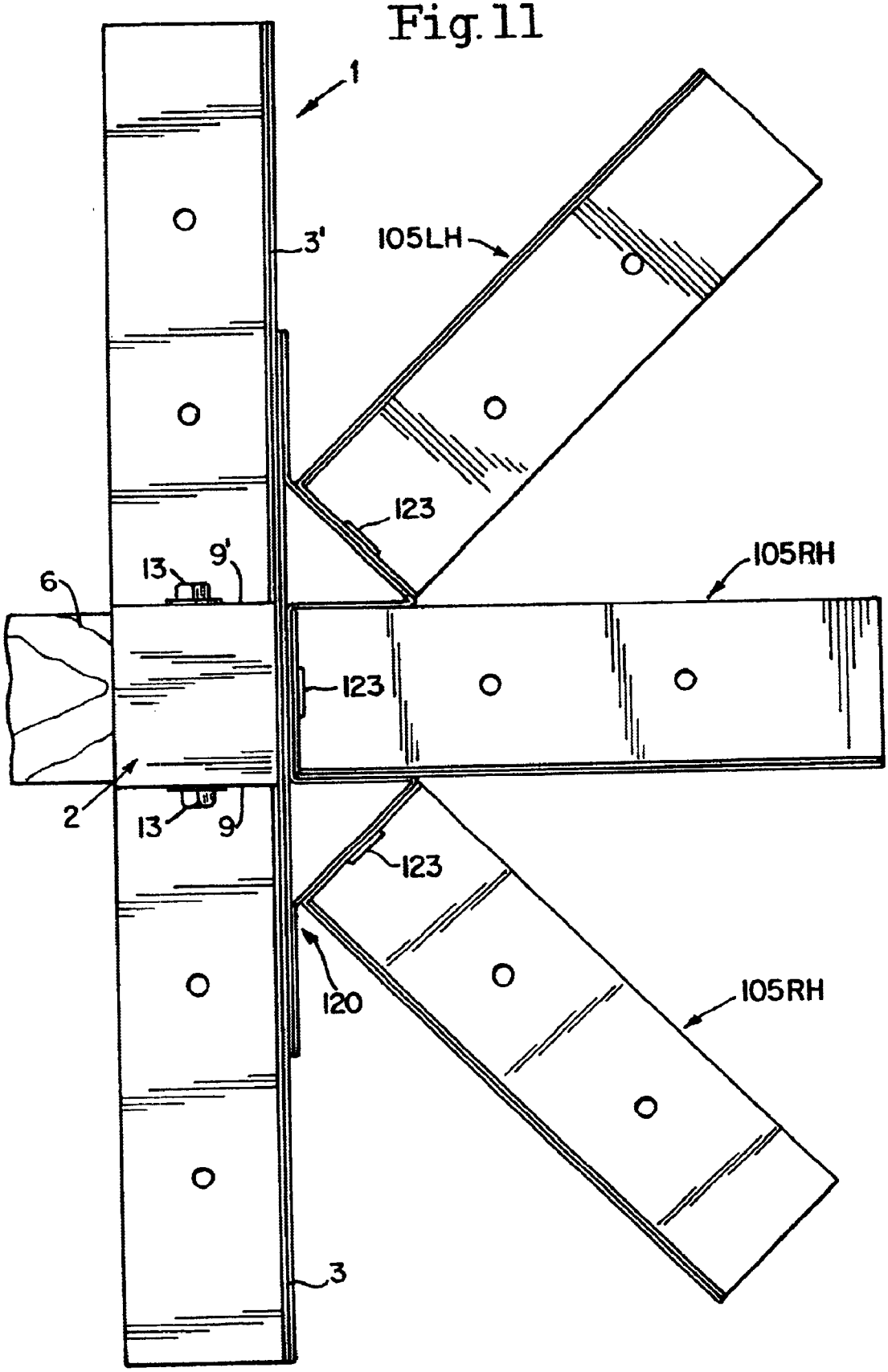
FIG. 11 is an illustration of the ridge hip assembly of FIG. 10.
Figure 12:
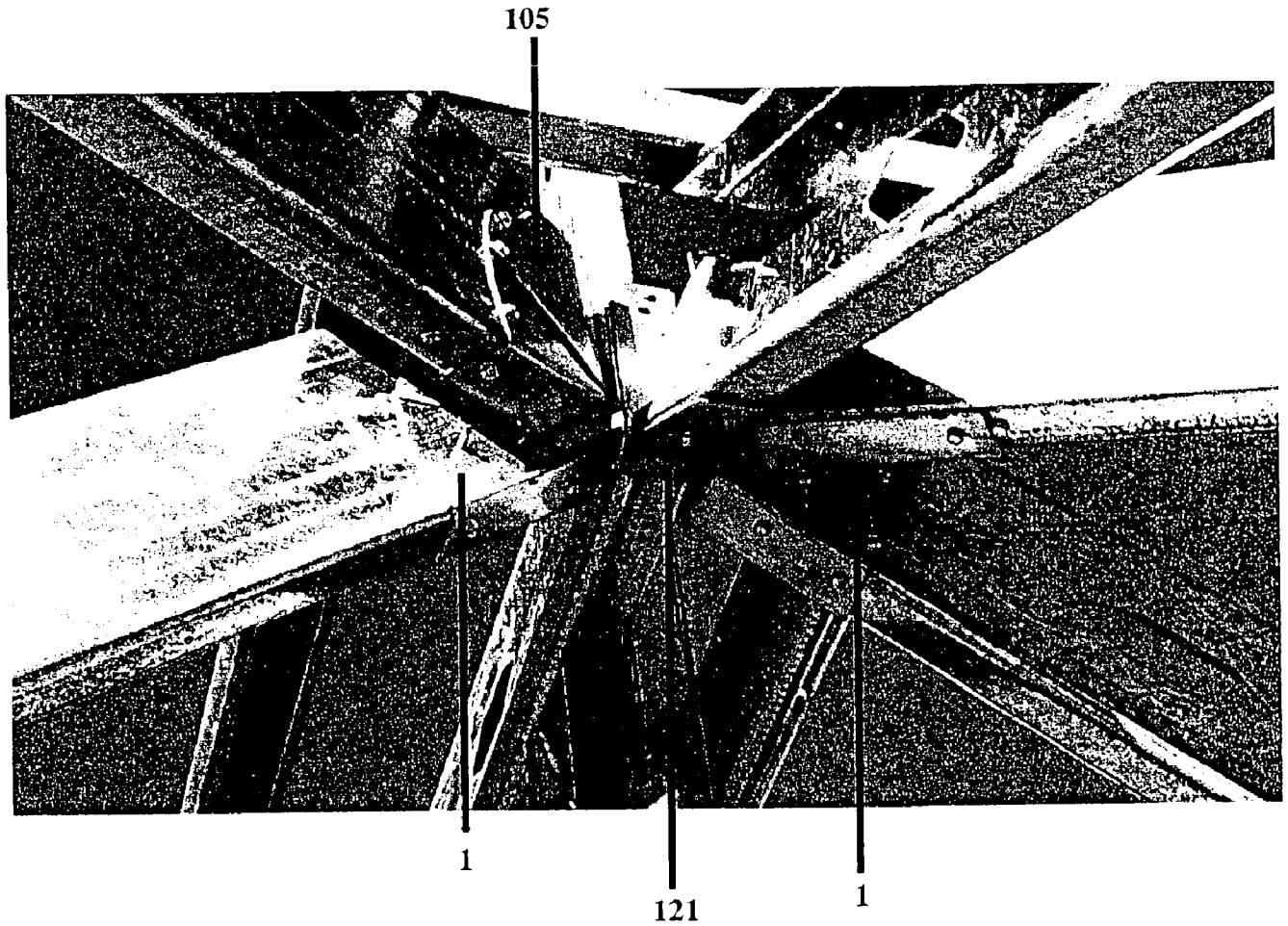
FIG. 12 is an illustration of one embodiment of a ridge hip bracket attached to one embodiment of a dual rafter bracket, and to one embodiment of single rafter brackets.
Figure 13:
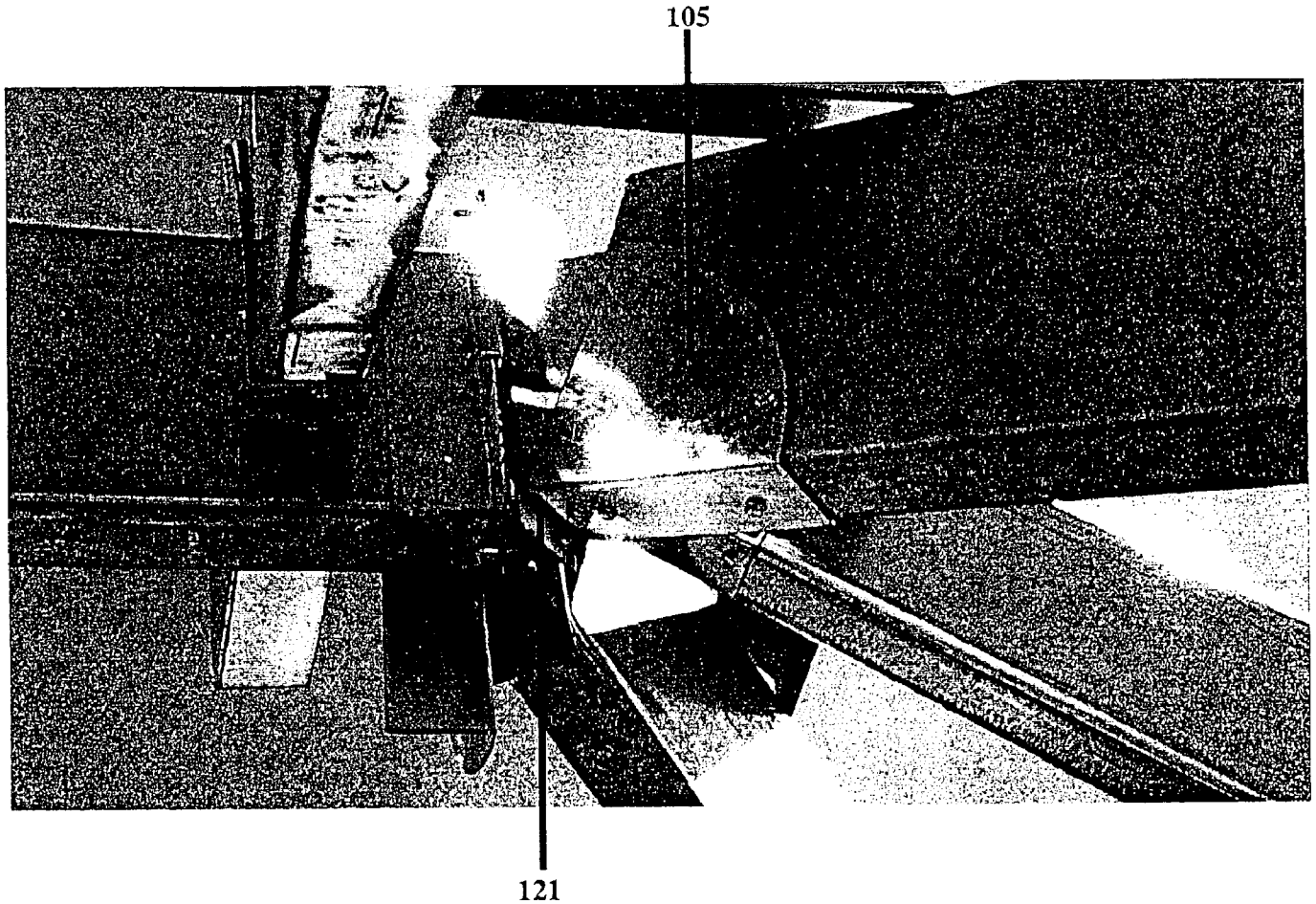
FIG. 13 is an illustration of one embodiment of a ridge hip with common bracket.

The dual rafter bracket 1 may include punch outs 151, 12, e.g., keyhole shaped punch outs such as, for example, single and double lug keyways, located in a fixed side panel(s) 3, 3' and/or a fixed base panel(s) 9, 9' (see, for example, FIGS. 1, 7). During the assembly of a hip roof, the last dual rafter bracket may be placed over the end of the ridge beam so that the fixed base panels 9, 9' are located at the very end of the ridge beam (see FIG. 11). The dual rafter bracket may hold two side king common rafters. With the dual rafter bracket attached to the ridge beam, the two fixed side panels 3, 3' may form a plane that is at the end of, and perpendicular to the ridge beam. The ridge hip bracket 120 may then be attached.

The ridge hip with common bracket 121 (see FIGS. 9, 11) may be a sheet metal bracket that is bent to lie flat against the fixed side panels of the dual rafter bracket. The ridge hip bracket may include two surfaces that are bent substantially at a 45 degree angle from the common rafter and one surface that is parallel to the fixed side panels of the dual rafter bracket. The ridge hip w/common bracket allows for the assembly of the hip rafters and the end king common rafter at the end of the ridge beam (see, for example, FIG. 11). The ridge hip without common bracket 122 may be a similar bracket and perform the same function, and may be made with two substantially 45 degree surfaces that support the two hip rafters, but the end king common rafter may not be included in this assembly (see, for example, FIG. 14).

The ridge hip w/common bracket and the ridge hip w/o common bracket may be both made with male lugs 123 (e.g., four male lugs) located so as to fit in and lock securely, in the single lug keyways 151 on the fixed side panels 3, 3' of the dual rafter bracket 1. While shown with male lug and lug keyway for an interlocking fit, any locking lug assembly will be adequate. This locking lug system allows for the assembly of the ridge hip bracket without the necessity of screws and/or allows the assembly without concern for the relative alignment of the hip rafters and the end king common rafter to the ridge beam.

Once the ridge hip bracket has been attached to the last dual rafter bracket on the ridge, the two hip rafters and the end king common rafter (if used) may then be assembled. A single rafter bracket (e.g., one half of a dual rafter bracket) may then be attached to each hip rafter and the end king common rafter (see, for example, FIGS. 10, 11). The single adjustable rafter bracket may include lug keyways 151 (e.g., two or more double lug keyways) located in the fixed side panel and/or the fixed base panel of the bracket (see, for example, FIG. 8). These double lug keyways may fit over corresponding lugs located on the ridge hip bracket and may allow the assembly of the rafters without screws (see, for example, FIG. 11).

Because the hip rafters are positioned substantially at a 45 degree offset from the common rafters, a vertical adjustment known as "hip drop" may be made in order to keep the nailing edge of the common rafter and the hip rafter in the same horizontal plan. The amount of hip drop is a factor of the pitch of the roof and the thickness of the hip. The majority of roofs on residential houses range from a minimum pitch of 3 inches of rise to every foot of run (3/12 pitch) to a maximum pitch of 14 inches of rise for every foot of run (14/12 pitch).

The ridge hip bracket may provide for the "hip drop" adjustment. This adjustment may be obtained from the relative distance of the lugs 123 that attach the ridge hip bracket to the dual rafter bracket and the lugs 123 that attach the hip to the ridge hip bracket (see, for example, FIG. 9). The "hip drop" compensation, which may be designed into the bracket, may be adjustable. For example, spacers (e.g., small spacers) may be provided that attach to the locking lugs, and adjust the amount of hip drop. The size of the spacer may be determined by the roof pitch.

The hip drop range depends on the thickness of the hip. A table is provided that shows the amount that the hip may be lowered below the common rafter. It is not necessary to drop the hip for each increment of pitch change. However, the bracket may be set up to accommodate a drop of ⅜". This adjustment is about in the middle and will minimize the impact of the roof plane at the hip.

| SLOPE | RISE/17 | X .75" | HIP DROP | X 1.0 | HIP DROP |
|---|---|---|---|---|---|
| 3/12 | .176471 | .132353 | 1/8 | 1.76471 | 3/16 |
| 4/12 | .235234 | .176471 | 3/16 | .235234 | 1/4 |
| 5/12 | .294118 | .220589 | 7/32 | .294118 | 5/16 |
| 6/12 | .352941 | .264706 | 1/4 | .352841 | 11/32 |
| 7/12 | .411765 | .308824 | 5/16 | .411765 | 3/8 |
| 8/12 | .470588 | .352941 | 11/32 | .470588 | 15/32 |
| 9/12 | .529412 | .397059 | 3/8 | .529412 | 1/2 |
| 10/12 | .588235 | .441176 | 7/16 | .588235 | 9/16 |
| 11/12 | .647059 | .485294 | 15/32 | .647059 | 5/8 |
| 12/12 | .705882 | .529412 | 1/2 | .705882 | 11/16 |
| 13/12 | .764706 | .573530 | 9/16 | .764706 | 3/4 |
| 14/12 | .823529 | .617647 | 5/8 | .823529 | 13/16 |

The dual and single rafter brackets may be designed with the "L" shape (see, for example, FIGS. 7 and 8) to allow the various thickness of members present in the steel framing industry. The brackets may accommodate from 1.5" to 2.125".

The width of each roof member is also a consideration to the success of a roof framing system. Historically, the size of the ridge beam, in wood construction, is one dimension size larger than the common rafter, e.g., 2"×6" rafter & a 2"×8" ridge beam. The wood rafter is typically cut at the top, with the vertical plum cut, where the rafter joins the ridge beam. The length of the vertical plum cut is longer than the rafter size and the larger dimension of the ridge beam allows a greater surface area of contact for nailing. Since the hip rafter carries a greater load and is longer than the common rafter, the hip rafter is normally one dimension size larger than the common rafter.

In roof framing with steel, the variety of component size adjustments can be greater than in a wood system. In a wood system, the dimensional lumber's nominal size increases incrementally by 2", with typical roof framing material being 2×6, 2×8, 2×10, & 2×12. The actual size of this material is 1½" thick and 5½", 7½", 9¼" & 11¼" wide respectively. To increase the strength of any member, using wood, the width of that member may be increased, or a composite beam with a double thickness may be made by using double up members. With steel, however, more choices are available. A standard steel "c" stud with a width of 1½", 1⅝" or 2" may be used. The member's strength may also be increased by capping the stud with a piece of track of appropriate size. The stud material's thickness (gauge) may also be increased, thereby increasing its strength. As with wood, the width of the stud may be increased to increase its strength. Standard size studs run 3½", 3⅝", 5½", 6", 8", 10" & 12".

In steel roof framing, the size of the ridge beam may be the same, greater or possibly even smaller than the common rafter size. The size of the hip rafter may also range from smaller, equal to or larger than the common rafter. Typically, however, the size of the roofing members of a steel framed roof will be within a 2" increment of one another. Since both wood and steel roof framing typically use a 2" incremental differential in member width, one embodiment of the roof framing system may provide a mechanical, 2" fixed adjustment in the single rafter bracket, which allows the user to adjust the bracket position by 2", to accommodate a dimensional change in the various members.

To accomplish this, the single rafter bracket may include lug keyways (e.g., three or more double lug keyways) located on the fixed side panel and/or the fixed base panel of the bracket. For example, three keyways may be spaced 2" apart so that when located on the two male locking lugs on the ridge hip bracket or the 45 degree bracket, the single rafter bracket can simply be relocated 2" vertically by using the middle and top lug keyways or the bottom and middle lug keyways. The spacing on the ridge hip bracket may also be designed to accommodate a stud width of 1½", 2" or the slightly larger 2" member with attached track.

After attaching the hip rafter to the hip rafter bracket to the end of the ridge, the hip rafter may then be accurately located, centered and supported at the top plate with the hip plate bracket 115. The hip plate bracket may be a sheet metal bracket shaped in a substantially 45 degree pie shape with vertical extensions 116, 117 bent in opposite directions, on each side of the pie shape (see, for example, FIGS. 21–23). The outside or short extension 116, may be a predetermined width for the entire one side of the pie shape and may be bent down from the level plane 90 degrees. On the other side of the pie shape, the inside of the triangular extension 117 may be bent upward from the level plane 90 degrees. The height of this extension, from the level pie shape may start at 0" at the apex of the two sides of the pie and increase along the edge of the pie shape reaching a predetermined height.

The hip plate bracket (see, for example, FIG. 23) may be placed on top of the exterior wall's top plate (e.g., top track) such that the pie shaped portion of the bracket is level with the top track, the apex of the two straight sides is facing the exterior corner of that wall and the short extension is riding over and up against the outside edge of the wall's top track. In this position, the triangular extension is now at a 45 degree angle to the edge of the exterior wall and is 90 degrees vertical to the top plane of the wall track. The apex of the two straight sides of the pie shaped bracket is resting on the outside edge of the exterior wall track. As the bracket is moved toward the outside corner, the triangular extension forms a perpendicular plane to the top track and parallel to the hip rafter. The bracket is moved along the outside wall, toward the corner until it comes to a point, one half the width of the hip rafter from the wall corner. The bracket is then fastened to the side of the top track or plate through the short extension and/or fastened to the top track or plate through the pie shaped section of the bracket. The hip rafter is placed in position in the corner and may be flat against the triangular extension of the hip plate bracket. The hip rafter is then fastened to the triangular extension of the hip plate bracket. The short extension of the bracket may extend vertically long enough to extend below the bottom of the top plate. This allows for fastening of the short extension to the vertical wall studs in the corner, which thus provides the additional benefit of acting as a hurricane clip, attaching the stud mechanically to the rafter.

This same bracket may be used to attach the bottom of the valley rafter to the exterior wall at an inside corner. To accomplish this, the bracket may be placed on top of the top plate of the wall such that the short extension is against the inside edge of the exterior wall plate. The apex of the brackets two straight sides is located against the inside wall edge and moved toward the interior corner. The triangular extension is now parallel to the valley rafter.

Another embodiment of a hip plate bracket 115 (see, for example, FIGS. 21–23) may include a first surface, a second surface, and a third surface. The first surface may be attached to a top plate of a wall. The second surface may extend from the first surface, and may be attached to a rafter. The third surface may extend from the first surface, and may be attached to a wall stud. The bracket is configured to attach the rafter to the wall stud. The rafter may be a hip rafter and/or a valley rafter.

The plate bracket 110 (see, for example, FIG. 15) may include first 111 and second 112 fixed base surfaces, first 113 and second 114 movable base surfaces, a movable side surface 161, and a fixed side surface 162. The second fixed base surface 112 extends from the first fixed base surface 111. The first movable base surface 113 extends from the second fixed base surface 112, and is movably attached to the second fixed base surface 112 to move the first movable base surface 113 relative to the second fixed base surface 112. The second movable base surface 114 extends from the first movable base surface 113 and is movably attached to the first movable base surface 113 to move the second movable base surface 114 relative to the first movable base surface 113. The movable side, surface 161 extends from the first movable base surface 113, and is configured to be movable relative to the second fixed base surface 112. The fixed side surface 162 extends from the second fixed base surface 112. The fixed side surface 162 is attached to the movable side surface 161 to fixedly secure the movable side surface 161 and the first movable base surface 113 relative to the second fixed base surface 112. The second movable base surface 114 may engage a rafter. The second fixed base surface 112 is configured to engage a top plate 130 of a wall. The first fixed base surface 111 is configured to be attached to one or more wall studs such that the plate bracket may act as a hurricane clip.

One embodiment of the roof framing system may include:

The hip ridge bracket is attached to the dual rafter bracket without screws and its required position is mechanically fixed by lugs and keyways and thus eliminates potential assembly error and speeds assembly;

The hip ridge bracket has the capability to mechanically compensate for a dimensional change in the width of its components by 2";

The ridge hip bracket is designed to mechanically adjust for "Hip Drop". This eliminates assembly errors and speeds installation;

The single rafter bracket allows for a mechanical connection to the hip ridge bracket without the necessity of screws. This eliminates assembly error and speeds installation;

The single rafter bracket has a two position adjustment that allows for the capability to adjust for dimensional changes of 2" in the component's size. This allows for the multiple usage of the brackets, eliminates assembly error and speeds installation; and/or The hip plate bracket can be used for both hips and valleys and accurately locates and fastens the hip or valley rafter at a 45 degree angle from the exterior wall. This eliminates assembly error and speeds installation. The bracket is multi-purposed, used for both hips and valleys. The bracket also has a dual function by acting as a hurricane clip, thus eliminating another required bracket and providing for a stronger assembly.

Another embodiment of a roof framing system may include a first bracket (e.g., a dual rafter bracket 1), a second bracket (e.g., a ridge hip bracket 120 and/or a single rafter bracket 105), and/or a third bracket (e.g., a single rafter bracket 105). The second bracket may attach a rafter, through the first bracket, to a beam. The first bracket and/or the second bracket may include one or more projections for interlocking with the other one of (i) the first bracket and (ii) the second bracket such that the second bracket can be moved between a fixed position and a released position by moving the second bracket relative to the first bracket to attach the rafter, through the first bracket, to the beam.

Also, the third bracket may attach the rafter, through the second bracket, to the beam. The second bracket and/or the third bracket may include one or more projections for interlocking with the other one of (i) the second bracket and (ii) the third bracket such that the third bracket can be moved between a fixed position and a released position by moving the third bracket relative to the second bracket to attach the rafter, through the second bracket, to the beam.

Another embodiment of a roof framing system may include a first bracket (e.g., a 45 degree bracket,125) and a second bracket (e.g., a single rafter bracket 105). The first bracket may be attached to a first supporting member extending in a first direction. The second bracket may be attached to a second supporting member extending at an angle to the first direction. The first bracket and/or the second bracket may include one or more projections for interlocking with the other one of (i) the first bracket and (ii) the second bracket such that the second bracket can be moved between a fixed position and a released position by moving the second bracket relative to the first bracket to attach the second supporting member to the first supporting member. The second supporting member may extend substantially at a 45 degree angle to the first direction.

The first bracket (e.g., a 45 degree bracket 125) may include a base surface extending in the first direction, and a side surface extending from the base surface at the angle to the first direction. The base surface may engage the first supporting member. The side surface may include the one or more projections for interlocking with the second bracket to attach the second supporting member to the first supporting member.

Another embodiment of a roof framing system may include a first bracket (e.g., a dual rafter bracket 1 and/or a ridge hip bracket 120), a plurality of second brackets (e.g., single rafter brackets 105), and/or a third bracket (e.g., a 45 degree bracket 125). A first one of the plurality of second brackets may be attached to a first end of a rafter, and the second one of the plurality of second brackets may be attached to a second end of the rafter. The first bracket may be coupled, through the first one of the plurality of the second brackets, to the rafter. The third bracket may be coupled, through the second one of the plurality of the second brackets, to the rafter.

The first bracket and/or the first one of the second brackets may include one or more projections for interlocking with the other one of (i) the first bracket and (ii) the first one of the second brackets such that the first one of the second brackets can be moved between a fixed position and a released position by moving the first one of the second brackets relative to the first bracket to couple the first bracket, through the first one of the second brackets, to the rafter.

The third bracket and/or the second one of the second brackets may include one or more projections for interlocking with the other one of (i) the third bracket and (ii) the second one of the second brackets such that the second one of the second brackets can be moved between a fixed position and a released position by moving the second one of the second brackets relative to the third bracket to couple the third bracket, through the second one of the second brackets, to the rafter.

Another embodiment of a roof framing system may include a first bracket (e.g., a dual rafter bracket 1 and/or a ridge hip bracket 120) and a plurality of second brackets (e.g., single rafter brackets 105). The first bracket may be attached to a beam. A first one of the plurality of the second brackets may be attached to (i) a first one of the plurality of rafters and (ii) the first bracket to secure the first one of the second brackets to the beam through the first bracket. A second one of the plurality of the second brackets may be attached to (i) a second one of the plurality of rafters and (ii) the first bracket to secure the second one of the second brackets to the beam through the first bracket. A third one of the plurality of the second brackets may be attached to (i) a third one of the plurality of rafters and (ii) the first bracket to secure the third one of the second brackets to the beam through the first bracket.

The first bracket and/or the second brackets may include one or more projections for interlocking with the other one of (i) the first bracket and (ii) the second brackets such that the second brackets can be moved between a fixed position and a released position by moving the second brackets relative to the first bracket to secure the second brackets to the beam through the first bracket.

The foregoing presentation of the described embodiments is provided to enable any person skilled in the art to make or use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and novel features disclosed in any fashion herein.

What is claimed is:

1. A variable pitch, dual-connector bracket, comprising:

a base member configured for attachment to a bearing member, the base member having a top section for resting on a corresponding top section of the bearing member and first and second side sections for attachment to corresponding first and second side sections of the bearing member;

first and second pivotable seat members configured for attachment to first and second structural support members, respectively; the first and second pivotable seat members being pivotally attached to the respective first and second side sections of said base member at respective first and second rafter index lines so as to be rotatable to varying pitch positions relative to the base member, wherein each rafter index line is constituted by an intersection of a bottom edge of the side section of the base member and a top edge of the pivotable seat member;

first and second movable side members attached to the first and second pivotable seat members, respectively, so as to be capable of rotating with the seat members relative to the first and second side sections of the base member, and first and second fixed side members attached to the first and second side sections, respectively, of the base member and attached to the first and second movable side members so as to maintain the movable side members at a desired pitch position, wherein each of the first and second pivotable seat members is not attached to a pair of movable side members, and wherein each of the first and second side sections of the base member is not attached to a pair of fixed side members.

2. A bracket according to claim 1, wherein the bearing member for which the base member is configured is a ridge board.

3. A bracket according to claim 1, wherein the first and second structural support members for which the first and second pivotable seat members are configured are both rafters.

4. A bracket according to claim 1, wherein the bearing member for which the base members configured is a ridge board, and the first and second structural support members for which the first and second pivotable seat members are configured are both rafters.

5. A bracket according to claim 1, wherein the first and second fixed side members are integrally attached to the first and second side sections of the base member, the first and second pivotable seat members are integrally attached to the first and second side sections of the base member, and the first and second movable side members are integrally attached to the first and second pivotable seat members.

6. A bracket according to claim 1, wherein the pivotable seat members are capable of being pivoted to a slope of from 0° to about 90°.

7. A bracket according to claim 1, wherein the pivotable seat members have been pivoted to a slope of from 0° to about 90°.

8. A bracket according to claim 1, wherein the bracket is made from metal.

9. A bearing member/support member/bracket assembly, comprising:

a variable pitch, dual-connector bracket of claim 1;

a bearing member attached to the base member of the bracket, such that the top section of the base member rests on the corresponding top section of the bearing member and the first and second side sections of the base member are attached to the corresponding first and second side sections of the bearing member; and first and second structural support members disposed in and attached to the first and second pivotable seat members, respectively, of the bracket, such that a bottom alignment edge of a bearing member end of each of the structural support members is disposed adjacent to one of the rafter index lines, the first and second pivotable seat members being positioned at a desired slope relative to the base member of the bracket.

10. An assembly according to claim 9, wherein the bearing member is a ridge board.

11. An assembly according to claim 9, wherein the first and second structural support members are both rafters.

12. An assembly according to claim 9, wherein the bearing member is a ridge board, and the first and second structural support members are both rafters.

13. An assembly according to claim 9, wherein the pivotable seat members are capable of being pivoted to a slope of from 0° to about 90°.

14. An assembly according to claim 9, wherein the pivotable seat members have been pivoted to a slope of from 0° to about 90°.

15. An assembly according to claim 9, wherein the bearing member and the structural support members are made of wood, plastic, metal or an engineered composite material.

16. An assembly according to claim 9, wherein the bracket is made from metal.

17. A method of attaching first and second structural support members to a bearing member, comprising the steps of:

(1) providing the variable pitch, dual-connector bracket of claim 1, wherein the first and second pivotable seat members have been pivoted to a desired pitch position and the first and second movable side members have been attached to the first and second fixed members at one or more overlapping fastening positions so as to maintain the desired slope;

(2) attaching the base member of the bracket to the bearing member; and (3) attaching the first structural support member to the first pivotable seat member and the second structural support member to the second pivotable seat member such that the bottom alignment edge of the bearing member end of the first structural support member is disposed adjacent to the first rafter index line and the bottom alignment edge of the bearing member end of the second structural support member is disposed adjacent to the second rafter index line.

18. A method according to claim 17, wherein the bearing member is a ridge board.

19. A method according to claim 17, wherein the first and second structural support members are both rafters.

20. A method according to claim 17, wherein the bearing member is a ridge board, and the first and second structural support members are both rafters.

21. A method according to claim 17, wherein the pivotable seat members are capable of being pivoted to a slope of from 0° to about 90°.

22. A method according to claim 17, wherein the pivotable seat members have been pivoted to a slope of from 0° to about 90°.

23. A method according to claim 17, wherein the bearing member and the structural support members are made of metal, wood, plastic or an engineered composite material.

24. A method according to claim 17, wherein the bracket is made from metal.

25. A bracket according to claim 1, wherein the first and second movable side members are attached at 90° to the first and second pivotable seat members, respectively, and wherein the first and second fixed side members are attached at 90° to the first and second side sections, respectively, of the base member and are variably and overlappingly attached to the first and second movable side members.

26. A variable pitch, mono-connector bracket, comprising:

a base member configured for attachment to a bearing member, the base member having a top section for resting on a corresponding top section of the bearing member and a side section for attachment to a corresponding side section of the bearing member;

a pivotable seat member configured for attachment to a structural support member, the pivotable seat member being pivotally attached to the side section of said base member at a rafter index line so as to be rotatable to varying pitch positions relative to the base member, wherein the rafter index line is constituted by an intersection of a bottom edge of the side section of the base member and a top edge of the pivotable seat member;

a movable side member attached to the pivotable seat member so as to be capable of rotating with the pivotable seat member relative to the side section of the base member; and a fixed side member attached to the side section of the base member and attached to the movable side member so as to maintain the movable side member at a desired pitch position, wherein the pivotable seat member is not attached to a pair of movable side members, and wherein the side section of the base member is not attached to a pair of fixed side members.

27. A bracket according to claim 26, wherein the bearing member for which the base member is configured is selected from the group consisting of a ridge board, a hip rafter, a valley rafter, a ledger, a post, or a stud.

28. A bracket according to claim 26, wherein the structural support member for which the pivotable seat member is configured is selected from the group consisting of a common rafter a hip rafter, a valley rafter, a hip jack rafter, a hip valley cripple jack rafter, a valley cripple jack rafter, and a joist.

29. A bracket according to claim 26, wherein the bearing member for which the base member is configured is selected from the group consisting of a ridge board, a hip rafter, a valley rafter, a ledger, a post, or a stud, and the structural support member for which the pivotable seat member is configured is selected from the group consisting of a common rafter, a hip rafter, a valley rafter, a hip jack rafter, a hip valley cripple jack rafter, a valley cripple jack rafter, and a joist.

30. A bracket according to claim 26, wherein the fixed side member is integrally attached to the side section of the base member, the pivotable seat member is integrally attached to the side section of the base member, and the movable side member is integrally attached to the pivotable seat member.

31. A bracket according to claim 26, wherein the pivotable seat member is capable of being rotated to a slope of from 0° to about 90°.

32. A bracket according to claim 26, wherein the pivotable seat member has been pivoted to a slope of from 0° to about 90°.

33. A bracket according to claim 26, wherein the bracket is made from metal.

34. A bearing member/support member/bracket assembly, comprising:

a variable pitch, mono-connector bracket of claim 26;

a bearing member attached to the base member of the bracket, such that the top section of the base member rests on the corresponding top section of the bearing member and the side section of the base member is attached to the corresponding side section of the bearing member; and a structural support member disposed in and attached to the pivotable seat member of the bracket such that a bottom alignment edge of the bearing-member end of the structural support member is disposed adjacent to the rafter index line, the pivotable seat member being positioned at a desired pitch relative to the base member of the bracket.

35. An assembly according to claim 34, wherein the bearing member is selected from the group consisting of a ridge board, a hip rafter, a valley rafter, a ledger, a post, or a stud.

36. An assembly according to claim 34, wherein the structural support member is selected from the group consisting of a common rafter, a hip rafter, a valley rafter, a hip jack rafter, a hip valley cripple jack rafter, a valley cripple jack rafter, and a joist.

37. An assembly according to claim 34, wherein the bearing member is selected from the group consisting of a ridge board, a hip rafter, a valley rafter, a ledger, a post, or a stud, and the structural support member is selected from the group consisting of a common rafter, a hip rafter, a valley rafter, a hip jack rafter, a hip valley cripple jack rafter, a valley cripple jack rafter, and a joist.

38. An assembly according to claim 34, wherein the pivotable scat member is capable of being pivoted to a slope of from 0° to about 90°.

39. An assembly according to claim 34, wherein the pivotable seat member has been pivoted to a slope of from 0° to about 90°.

40. An assembly according to claim 34, wherein the bearing member and the structural support members are made of metal, wood, plastic or an engineered composite material.

41. An assembly according to claim 34, wherein the bracket is made from metal.

42. A method of attaching a single structural support member to a bearing member, involving the steps of:

(1) providing the variable pitch, mono-connector bracket of claim 9, wherein the pivotable seat member has been pivoted to a desired pitch position and the movable side member has been attached to the fixed member at one or more overlapping fastening positions so as to maintain the desired slope;

(2) attaching the base member of the bracket to the bearing member; and (3) attaching the structural support member to the pivotable seat member such that the bottom alignment edge of the bearing-member end of the structural support member is disposed adjacent to the rafter index line.

43. A method according to claim 42, wherein the bearing member is selected from the group consisting of a ridge board, a hip rafter, a valley rafter, a ledger, a post, or a stud.

44. A method according to claim 42, wherein the structural support member is selected from the group consisting of a common rafter, a hip rafter, a valley rafter, a hip jack rafter, a hip valley cripple jack rafter, a valley cripple jack rafter, and a joist.

45. A method according to claim 42, wherein the bearing member is selected from the group consisting of a ridge board, a hip rafter, a valley rafter, a ledger, a post, or a stud, and the structural support member is selected from the group consisting of a common rafter, a hip rafter, a valley rafter, a hip jack rafter, a hip valley cripple jack rafter, a valley cripple jack rafter, and a joist.

46. A method according to claim 42, wherein the pivotable seat member is capable of being pivoted to a slope of from 0° to about 90°.

47. A method according to claim 42, wherein the pivotable seat member has been pivoted to a slope of from 0° to about 90°.

48. A method according to claim 42, wherein the bearing member and the structural support member are made of metal, wood, plastic or an engineered composite material.

49. A method according to claim 42, wherein the bracket is made from metal.

50. A bracket according to claim 26, wherein the movable side member is attached at a 90° angle to the pivotable seat member, and wherein the fixed side member is attached to a 90° angle to the side section of the base member and is variably and overlappingly attached to the movable side member.

51. A dual rafter bracket comprising:

first and second fixed base surfaces;

first and second movable base surfaces extending from the respective first and second fixed base surfaces, and movably attached to the respective first and second fixed base surfaces to move the movable base surfaces relative to the fixed base surfaces;

first and second movable side surfaces extending from the respective first and second movable base surfaces, and configured to be movable relative to the fixed base surfaces; and first and second fixed side surfaces extending from the respective first and second fixed base surfaces, wherein the first fixed base surface is coupled to the second fixed base surface, wherein the fixed base surfaces engage one or more beams, and wherein the first and second fixed side surfaces (i) are attached to the respective first and second movable side surfaces to fixedly secure the movable side surfaces and the movable base surfaces relative to the fixed base surfaces and (ii) are configured to couple one or more rafters, through the fixed side surfaces, to the one or more beams.

52. The dual rafter bracket of claim 51, wherein the first and second fixed side surfaces include punch outs, and wherein the one or more rafters are coupled, through the punch outs of the fixed side surfaces, to the one or more beams.

53. The dual rafter bracket of claim 51, wherein the punch outs include lug keyways.

54. The dual rafter bracket of claim 53, wherein the lug keyways include single lug keyways.

55. The dual rafter bracket of claim 53, wherein the lug keyways include double lug keyways.

56. The dual rafter bracket of claim 51, wherein the fixed side surfaces form a plane located at an end surface of the beam, and oriented substantially parallel to the end surface of the beam.

57. A single rafter bracket comprising:

a fixed base surface;

a movable base surface extending from the fixed base surface, and movably attached to the fixed base surface to move the movable base surface relative to the fixed base surface;

a movable side surface extending from the movable base surface, and configured to be movable relative to the fixed base surface; and a fixed side surface extending from the fixed base surface, wherein the fixed base surface and the fixed side surface include lug openings, and wherein the fixed side surface is configured to be attached to the movable side surface to fixedly secure the movable side surface and the movable base surface relative to the fixed base surface.

58. The single rafter bracket of claim 57, wherein the lug openings include single lug keyways.

59. The single rafter bracket of claim 57, wherein the lug openings include double lug keyways.

60. The single rafter bracket of claim 57, wherein the fixed base surface has three lug openings.

61. The single rafter bracket of claim 60, wherein the three lug openings are vertically spaced approximately 2 inches apart from each other.

62. The single rafter bracket of claim 57, wherein the fixed base surface includes double lug keyways, and wherein the fixed side surface includes single lug keyways.

63. The single rafter bracket of claim 62, wherein the fixed base surface has three double lug keyways, and wherein the fixed side surface has two single lug keyways.

64. The single rafter bracket of claim 57, wherein the fixed base surface extends in a first direction, and wherein the movable base surface (i) extends substantially perpendicular to the first direction from the fixed base surface and (ii) engages a hip rafter.

65. A plate bracket comprising:

a first fixed base surface;

a second fixed base surface extending from the first fixed base surface;

a first movable base surface extending from the second fixed base surface, and movably attached to the second fixed base surface to move the first movable base surface relative to the second fixed base surface;

a second movable base surface extending from the first movable base surface and movably attached to the first movable base surface to move the second movable base surface relative to the first movable base surface;

a movable side surface extending from the first movable base surface, and configured to be movable relative to the second fixed base surface; and a fixed side surface extending from the second fixed base surface, wherein the fixed side surface is attached to the movable side surface to fixedly secure the movable side surface and the first movable base surface relative to the second fixed base surface, wherein the second movable base surface engages a rafter, wherein the first fixed base surface is configured to attach to one or more wall studs, and wherein the second fixed base surface is configured to engage a top plate of a wall.

66. A variable pitch, dual-connector bracket, comprising:

a base member configured for attachment to a bearing member, the base member having a top section for resting on a corresponding top section of the bearing member and first and second side sections for attachment to corresponding first and second side sections of the bearing member;

first and second pivotable seat members configured for attachment to first and second structural support members, respectively; the first and second pivotable seat members being pivotally attached to the respective first and second side sections of said base member at respective first and second rafter index lines so as to be rotatable to varying pitch positions relative to the base member, wherein each rafter index line is constituted by an intersection of a bottom edge of the side section of the base member and a top edge of the pivotable seat member;

first and second movable side members attached to the first and second pivotable seat members, respectively, so as to be capable of rotating with the seat members relative to the first and second side sections of the base member; and first and second fixed side members attached to the first and second side sections, respectively, of the base member and attached to the first and second movable side members so as to maintain the movable side members at a desired pitch position, wherein the top section of the base member includes a pre-stamped crease such that the top section of the base member can be separated, through the pre-stamped crease, into first and second portions without the need to use tools to convert the variable pitch, dual-connector bracket into a plurality of variable pitch, mono-connector brackets.

67. The bracket of claim 66, wherein each of the first and second pivotable seat members is not attached to a pair of movable side members, and wherein each of the first and second side sections of the base member is not attached to a pair of fixed side members.

* * * * *